US006000265A

United States Patent [19]

Itaya

[11] Patent Number: 6,000,265

[45] Date of Patent: Dec. 14, 1999

[54] SPRING MANUFACTURING APPARATUS

[75] Inventor: Ichiro Itaya, Tokyo, Japan

[73] Assignee: Kabushiki Kaisha Itaya Seisaku Sho, Tokyo, Japan

[21] Appl. No.: 09/093,380

[22] Filed: Jun. 8, 1998

[30] Foreign Application Priority Data

Jun. 10, 1997 [JP] Japan ..... 9-152552
Jan. 14, 1998 [JP] Japan ..... 10-005822

[51] Int. Cl.[6] ..... B21F 3/027

[52] U.S. Cl. ..... 72/138; 72/137; 72/140

[58] Field of Search ..... 72/135, 137, 138, 72/140, 145, 450, 446

[56] References Cited

U.S. PATENT DOCUMENTS 5,452,598 9/1995 Cheng ..... 72/137

FOREIGN PATENT DOCUMENTS 4-89148 3/1992 Japan .
07227635 8/1995 Japan .
07236931 9/1995 Japan .
08108238 4/1996 Japan .

*Primary Examiner*—Rodney Butler
*Attorney, Agent, or Firm*—Merchant & Gould P.C.

[57] ABSTRACT

A point tool assembly includes a vertical moving table disposed on a forming table and movable in a direction parallel to the forming table surface and perpendicular to the feed direction of a wire, and a longitudinal moving table disposed on the forming table and movable in a direction parallel to the forming table surface and the feed direction of the wire independently of the vertical moving table. A link arm moves a parallel slide table and first and second inclined slide tables the same distance upon longitudinal movement of the longitudinal moving table. A forming table includes first and second independent tool drive units for supporting first and second point tools in positions where the first and second point tools oppose the wire and moving the tools in a direction substantially parallel to the forming table surface and substantially perpendicular to the feed direction of the wire and in a direction parallel to the forming table surface and the feed direction of the wire. The first and second tool drive units are controlled independently of each other so that the end portions of the first and second point tools draw predetermined loci.

27 Claims, 32 Drawing Sheets

SPRING MANUFACTURING APPARATUS

BACKGROUND OF THE INVENTION

1. Field of the Invention

The present invention relates to a spring manufacturing apparatus and, more particularly, to a spring manufacturing apparatus for continuously feeding a wire to be formed into a compression spring or a tension spring, winding the wire into a predetermined coil diameter by pressing a point tool against the wire, and growing a coil having a predetermined pitch by winding the wire using a pitch tool, thereby forming a coil spring with a desired shape.

2. Description of the Related Art

[Twin pin right hand wind]

For example, as shown in FIG. 31, a spring manufacturing apparatus for forming a right hand coil by using two point tools has a forming table 102 parallel to the direction in which a wire is fed. On this forming table 102, feed rollers 110 for feeding a wire W, a mandrel 103 for applying shearing force to the wire in cooperation with a cutting tool (not shown) during cutting, and two point tool assemblies 116 and 126 are arranged. These two point tool assemblies 116 and 126 are radially arranged around an output portion O2 of the wire W from the feed rollers 110. The vertical position of the mandrel 103 on the forming table can be properly changed in accordance with the coil diameter. The mandrel 103 is arranged above a straight line along the feed direction of the wire W, and the distance from the output portion O2 of the wire W is set in accordance with a desired coil diameter.

The point tool assembly 116 is attached to a tool driving shaft R1 which is above the output portion O2 off to the right at an angle of 45°. The point tool assembly 116 has rails 111 fixed on the forming table, a slider 112 slidably disposed on the rails 111, and a driven shaft 113 which is disposed at one end of the slider 111 and abuts against a cam (not shown) pivotally, axially supported by the tool driving shaft R1. A tool fixing arm 114 is fixed to the slider 112, and a point tool T1 is fixed to the end portion of the tool fixing arm 114. This point tool T1 can be finely adjusted by a micrometer 115.

The point tool assembly 126 is attached to a tool driving shaft R2. The axial center of this tool driving shaft R2 is on a straight line L1 which passes through the output portion O2 and extends along the feed direction of the wire W. The tool driving shaft R2 is disposed to the right of the output portion O2. The point tool assembly 126 has components identical to those of the point tool assembly 116. Therefore, the same reference numerals denote the same components, and a detailed description thereof will be omitted. A tool fixing arm 124 is fixed to a slider 112, and a point tool T2 is fixed to the end portion of the tool fixing arm 124. This point tool T2 can be finely adjusted by a micrometer 125.

The tool fixing arms 114 and 124 are so constituted that the point tools T1 andT2 form an angle of 90° around a desired coil diameter.

[Twin pin left hand wind]

To form a left hand coil by using two point tools, as shown in FIG. 32, two point tool assemblies 136 and 146 are radially arranged around an output portion O2 of a wire W from feed rollers 110 on a forming table 102. A mandrel 103 is arranged below a straight line along the feed direction of the wire W, and the distance from the output portion O2 of the wire W is set in accordance with a desired coil diameter. Note that the same reference numerals as in the point tool assembly 116 explained in FIG. 31 denote the same parts in FIG. 32, and a detailed description thereof will be omitted.

The point tool assembly 136 is attached to a tool driving shaft R2. The axial center of this tool driving shaft R2 is on a straight line L1 which passes through the output portion O2 and extends along the feed direction of the wire W. The tool driving shaft R2 is disposed to the right of the output portion O2. A tool fixing arm 134 is fixed to a slider 112, and a point tool T1 is fixed to the end portion of the tool fixing arm 134. This point tool T1 can be finely adjusted by a micrometer 135.

The point tool assembly 146 is assembled to a tool driving shaft R3 which is below the output portion O2 off to the right at an angle of 45°. A tool fixing arm 144 is fixed to a slider 112, and a point tool T2 is fixed to the end portion of the tool fixing arm 144. This point tool T2 can be finely adjusted by a micrometer 145.

The tool fixing arms 134 and 144 are so constituted that the point tools T1 and T2 form an angle of 90° around a desired coil diameter.

[Single pin right hand wind]

To form a right hand coil by using one point tool, as shown in FIG. 33, one point tool assembly 156 is radially arranged around an output portion O2 of a wire W from feed rollers 110 on a forming table 102. A mandrel 103 is arranged above a straight line along the feed direction of the wire W, and the distance from the output portion O2 of the wire W is set in accordance with a desired coil diameter. Note that the same reference numerals as in the point tool assembly 116 explained in FIG. 31 denote the same parts in FIG. 33, and a detailed description thereof will be omitted.

The point tool assembly 156 is attached to a tool driving shaft R2. The axial center of this tool driving shaft R2 is on a straight line L1 which passes through the output portion O2 and extends along the feed direction of the wire W. The tool driving shaft R2 is disposed to the right of the output portion O2. A tool fixing arm 154 is fixed to a slider 112, and a point tool T1 is fixed to the end portion of the tool fixing arm 134. This point tool T1 can be finely adjusted by a micrometer 155.

The tool fixing arm 154 is so constituted that the point tool T1 is parallel to the straight line L1 which passes through the center of a desired coil diameter and extends along the feed direction of the wire W.

[Single pin left hand wind]

To form a left hand coil by using one point tool, as shown in FIG. 34, one point tool assembly 166 is radially arranged around an output portion O2 of a wire W from feed rollers 110 on a forming table 102. A mandrel 103 is arranged above a straight line along the feed direction of the wire W, and the distance from the output portion O2 of the wire W is set in accordance with a desired coil diameter. Note that the same reference numerals as in the point tool assembly 116 explained in FIG. 31 denote the same parts in FIG. 34, and a detailed description thereof will be omitted.

The point tool assembly 166 is attached to a tool driving shaft R3 which is off to the lower right of the output portion O2. A tool fixing arm 164 is fixed to a slider 112, and a point tool T1 is fixed to the end portion of the tool fixing arm 164. This point tool T1 can be finely adjusted by a micrometer 165.

The tool fixing arm 164 is so constituted that the point tool T1 is parallel to a straight line L1 which passes through the center of a desired coil diameter and extends along the feed direction of the wire W.

In the conventional spring manufacturing apparatus as described above, the point tools are slidably disposed to abut against a wire being fed and define the coil diameter of a spring. On the forming table, the arrangement of the point tools can be appropriately changed in accordance with a desired spring shape. The forming table defines thespring formation space in the apparatus main body.

Also, Japanese Patent Publication No. 2553406 has disclosed a coiling apparatus including a link mechanism which links two coiling pins.

In the above spring manufacturing apparatus, however, when the wind direction, the coil diameter, or the like of a coil is to be changed, it is necessary to readjust the relative positional relationship by removing the mandrel and the point tool assemblies from the forming table, while the tip shape of a tool is changed where necessary.

In the coiling apparatus disclosed in Japanese Patent Publication No. 2553406, on the other hand, to change the wind direction of a coil it is necessary to manually change the position of the link mechanism although the positions of slide members for sliding the two coiling pins need not be changed.

These efforts require much labor and time of workers, and skill is necessary to accurately set the tool positions.

SUMMARY OF THE INVENTION

The present invention has been made in consideration of the above situation and has as its object to provide a spring manufacturing apparatus in which when the wind direction, the coil diameter, or the like of a coil is to be changed, the relative positional relationship can be easily adjusted without removing point tools and their driving mechanisms from a forming table, while the tip shape of a tool is changed where necessary.

It is another object of the present invention to provide a spring manufacturing apparatus in which when the wind direction, the coil diameter, or the like of a coil is to be set or changed, this new coil diameter or the like can be easily set by changing only the relative positional relationship between point tools in the longitudinal and lateral directions.

It is still another object of the present invention to provide a spring manufacturing apparatus in which two point tools are arranged on tables which operate independently of each other, and these tables are vertically and horizontally moved to finely adjust the positional relationship between the two point tools by numerical control, thereby completely automating spring formation.

It is still another object of the present invention to provide a spring manufacturing apparatus in which the operations of two point tools can be numerically controlled independently of each other, so it is possible to properly control the loci of the two point tools when a spring with varying coil diameter is to be formed, finely adjust the cutting position of a coil to an appropriate position, and facilitate initial winding of a wire material.

It is still another object of the present invention to provide a spring manufacturing apparatus in which each table need only have a mechanism for vertically and horizontally moving one point tool, so it is possible to reduce the weights of a slide and the table, use a low-output motor to drive the table, and perform rapid operation.

To solve the above problems and achieve the objects, the present invention comprises the following arrangement.

That is, a spring manufacturing apparatus for forming a coil spring having a desired shape by feeding a wire (W) to be formed into a spring onto a forming table (2, 202) and pressing tools (T1, T2) disposed on the forming table against the fed wire comprises, on the forming table (2, 202), wire feeding means (10, 210) for feeding the wire (W) onto the forming table (2, 202), tool support means (39, 43, 242, 272) for supporting the tools (T1, T2) in positions where the tools oppose the fed wire (W), and moving means (30, 230, 260) for moving the tool support means (39, 43, 242, 272) in a direction substantially parallel to a forming table surface and substantially perpendicular to a wire feed direction (F) and in a direction substantially parallel to the forming table surface and the wire feed direction, wherein the moving means (30, 230, 260) moves the tool support means (39, 43, 242, 272) to make tool end portions draw predetermined loci with respect to the feed direction of the wire (W).

To solve the above problems and achieve the objects, a spring manufacturing apparatus of the present invention comprises the following arrangement.

That is, a spring manufacturing apparatus for forming a coil spring having a desired shape by feeding a wire (W) to be formed into a spring onto a forming table (202) and pressing tools (T1, T2) disposed on the forming table against the fed wire comprises, on the forming table, wire feeding means (210) for feeding the wire (W) onto the forming table, two independent moving means (230, 260) for supporting the tools (T1, T2) in positions where the tools oppose the wire and moving the tools in a direction substantially parallel to a forming table surface and substantially perpendicular to a wire feed direction and in a direction substantially parallel to the forming table surface and the wire feed direction, and control means (270) for controlling the moving means independently of each other to make tool end portions draw predetermined loci with respect to the wire feed direction.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Embodiments of the present invention will be described in detail below with reference to the accompanying drawings.

[First Embodiment]

[Outline of whole spring apparatus]

Figure 1:
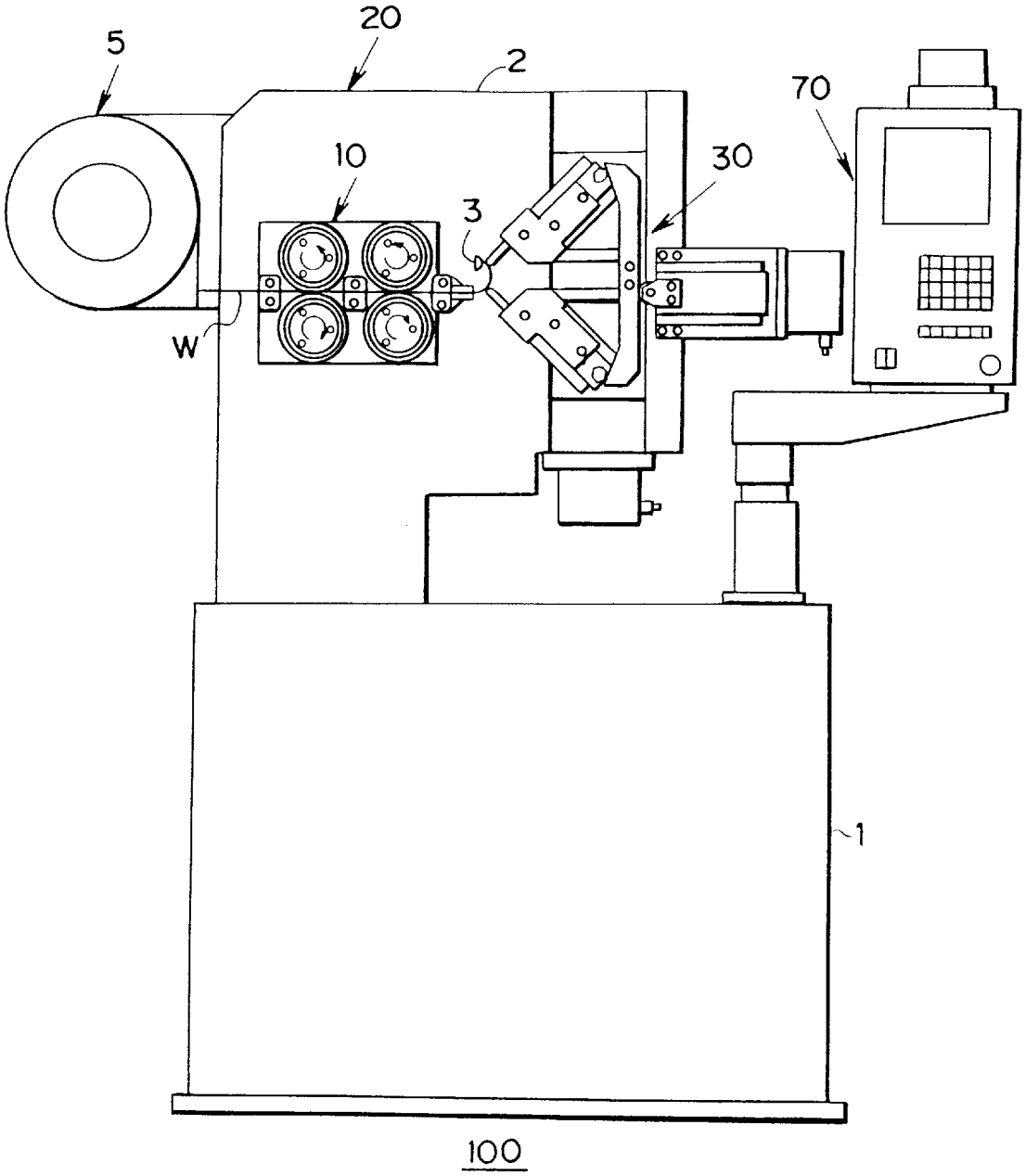
FIG. 1 is a schematic front view of a spring manufacturing apparatus according to one embodiment of the present invention.

FIG. 1 is a schematic front view of a spring manufacturing apparatus according to one embodiment of the present invention.

FIG. 1 shows that a spring manufacturing machine 100 of this embodiment is an apparatus for forming a helical compression spring having, e.g., a conical shape, an hourglass shape, or a barrel shape by giving a predetermined coil diameter and a predetermined pitch to a wire being fed. However, it is of course possible to form a helical tension spring or a helical torsion spring.

This spring manufacturing machine 100 comprises a box-like machine main body 1, a coiling assembly 20 mounted on the upper surface of the machine main body 1, a wire supply apparatus 5 for supplying a wire W to the coiling assembly 20, and a controller 70 for controlling the entire machine.

As will be described later, the coiling assembly 20 comprises a forming table 2, a feed mechanism 10 for feeding the wire W to the forming table 2, a mandrel 3, and a point tool assembly 30 including point tools.

The coiling assembly 20 further comprises a wedge tool and a push tool as pitch generating tools and a cutting tool (none shown).

The coiling assembly 20 has functions of feeding the wire W by the feed mechanism 10, forcedly curving the fed wire W by the point tool assembly, growing a coil by a predetermined coil diameter and a predetermined pitch by using the wedge tool and the push tool, and forming a coil spring by cutting the coil finally formed into a desired size by the cutting tool.

[Coiling assembly]

Details of the coiling assembly 20 will be described below.

Figure 2:
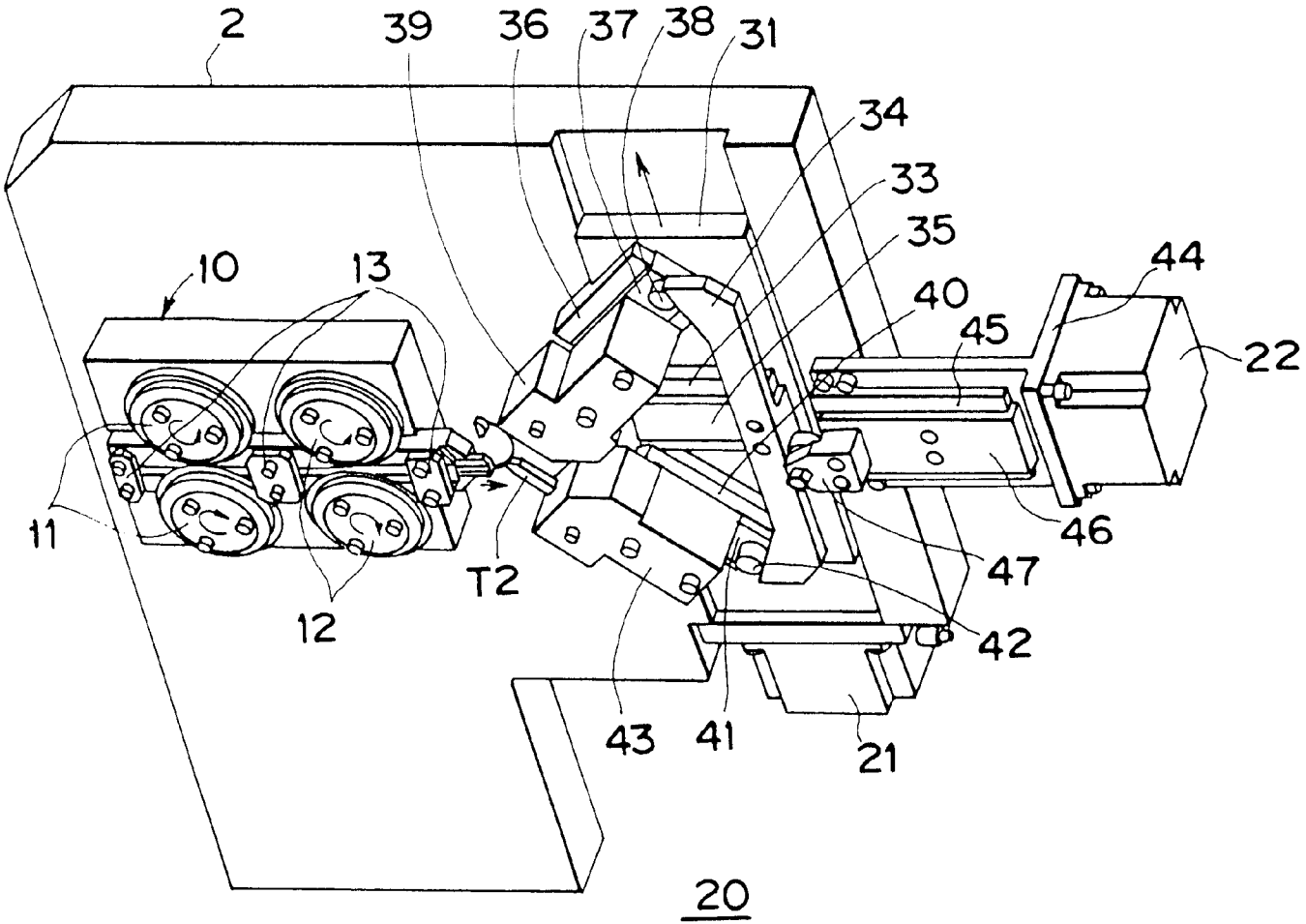
FIG. 2 is a perspective view showing a coiling assembly shown in FIG. 1 used to form a right hand coil by using two point tools.
Figure 3:
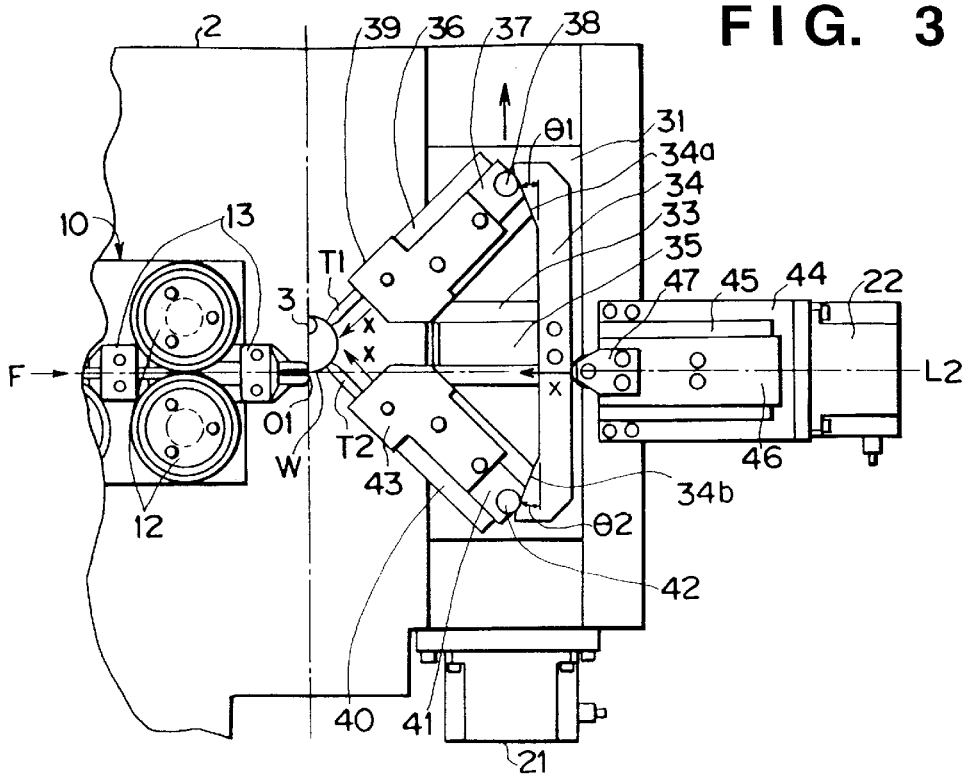
FIG. 3 is a front view showing a part of FIG. 2 in detail.
Figure 4:
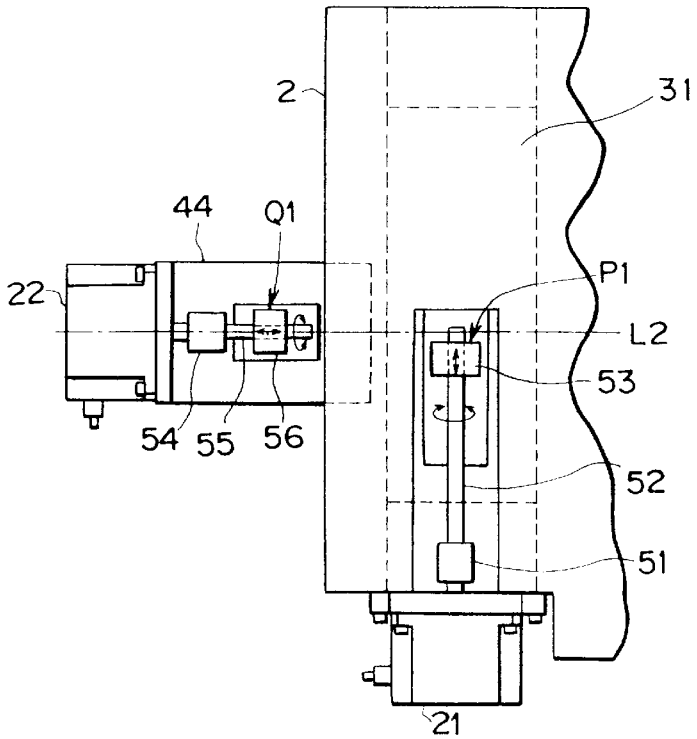
FIG. 4 is a rear view of FIG. 3.

FIG. 2 is a perspective view showing the external appearance of the coiling assembly 20 in FIG. 1. FIG. 3 is a front view showing a part of FIG. 2 in detail. FIG. 4 is a rear view of FIG. 3.

As shown in FIGS. 2 to 4, the forming table 2 fixed to the machine main body 1 is the base of the coiling assembly 20. This forming table 2 is made of, e.g., an L-shaped metal material having a plate thickness by which predetermined strength is obtained, and supports the feed mechanism 10, the mandrel 3, and the point tool assembly. The forming table 2 forms a plane parallel to the feed direction of the wire W, and this plane defines a spring formation space.

In the feed mechanism 10, three wire feed liners 13 for guiding the wire W in the feed direction (from left to right in the plane of the paper of FIG. 3) are disposed at predetermined intervals along the wire feed direction. Also, a pair of upper and lower upstream feed rollers 11 and a pair of upper and lower downstream feed rollers 12 are disposed between the three wire feed liners 13.

When the upstream and downstream feed rollers 11 and 12 are rotated in a feed direction F, the wire W is fed into a spring formation space (to be described later) while being guided by the wire feed liners 13.

The point tool assembly is disposed near the end portion extending sideways from the forming table 2 which is so supported by the machine main body 1 as to form an inverse L shape. This point tool assembly can move forward and backward and vertically with respect to the forming table 2.

The point tool assembly 30 is moved back and forth and vertically in order to change the wind direction or the coil diameter of a coil.

[Point tool assembly]

Details of the point tool assembly 30 will be described next.

As shown in FIGS. 2 to 4, the point tool assembly 30 comprises a vertical moving table 31 and a longitudinal moving table 46 disposed on the forming table 2. The vertical moving table 31 can move in a direction parallel to the forming table surface and perpendicular to the feed direction F of the wire W. The longitudinal moving table 46 can move in a direction parallel to the forming table surface and the feed direction F of the wire W independently of the vertical moving table 31.

As shown in FIG. 4, the vertical moving table 31 can be vertically moved by a vertical driving motor 21 arranged below the vertical moving table 31. The vertical driving motor 21 is connected to a mechanism of a screw rod 52 and a nut 53 by a joint 51. The nut 53 is fixed to the rear surface of the vertical moving table 31.

On the vertical moving table 31, a parallel slide table 35, two inclined slide tables 37 and 41, and a link arm 34 are disposed. The parallel slide table 35 can slide in the direction parallel to the forming table surface and the feed direction F of the wire W. The inclined slide tables 37 and 41 can move in a direction parallel to the forming table surface and inclined through approximately 45° to the feed direction of the wire W. The link arm 34 moves the parallel slide table 35 and the inclined slide tables 37 and 41 the same distance in connection with the movement of the longitudinal moving table 46.

The parallel slide table 35 is slidably disposed on parallel slide rails 33 fixed on the vertical moving table 31. The parallel slide rails 33 and the parallel slide table 35 are arranged in a central portion in the vertical direction of the vertical moving table 31. The link arm 34 (to be described later) is fixed to the right end portion of the parallel slidetable 35. A tool fixing block (to be described later) is fixed to the parallel slide table 35, and a point tool T3 can be fixed to the end portion of this tool fixing block.

The inclined slide tables 37 and 41 are a first inclined slide table 37 which intersects a straight line parallel to the feed direction F of the wire W counterclockwise at an angle of 45° at a wire output portion O1, and a second inclined slide table 41 which intersects the straight line parallel to the feed direction F of the wire W clockwise at an angle of 45° at the wire output portion O1.

The first inclined slide table 37 is slidably disposed on first inclined slide rails 36 fixed on the vertical moving table 31. A driven shaft 38 which abuts against the link arm 34 (to be described later) is disposed in the upper end portion of the first inclined slide rails 36. The first inclined slide table 37 is biased toward its upper end portion by a spring mechanism (not shown) so that the driven shaft 38 always abuts against the link arm 34. A tool fixing block 39 is also fixed to the first inclined slide table 36, and a point tool T1 is fixed to the end portion of this tool fixing block 39.

The second inclined slide table 41 is slidably disposed on second inclined slide rails 40 fixed on the vertical moving table 31. A driven shaft 42 which abuts against the link arm 34 (to be described later) is disposed in the lower end portion of the second inclined slide rails 40. The second inclined slide table 41 is biased toward its lower end portion by a spring mechanism (not shown) so that the driven shaft 42 always abuts against the link arm 34. A tool fixing block 43 is also fixed to the second inclined slide table 41, and a point tool T2 is fixed to the end portion of this tool fixing block 43.

The first and second inclined slide tables 37 and 41 and the point tools T1 and T2 are so arranged as to form an angle of 90° around a desired coil diameter, and are so slid as to converge into the center of a desired coil diameter.

As shown in FIG. 4, the longitudinal moving table 46 can be moved back and forth by a longitudinal driving motor 22 arranged in the right end portion of the longitudinal moving table 46. This longitudinal driving motor 22 is fixed by a stay 44 extended from the forming table 2. The stay 44 is arranged in a substantially central portion in the vertical direction in the right end portion of the forming table 2. The longitudinal driving motor 22 is connected to a mechanism of a screw rod 55 and a nut 56 by a joint 54. The nut 56 is fixed to the rear surface of the longitudinal moving table 46.

The longitudinal moving table 46 is slidably disposed on longitudinal slide rails 45 fixed on the stay 44. The longitudinal slide rails 45 and the longitudinal moving table 46 are arranged in a substantially central portion in the widthwise direction of the stay 44. A roller mechanism 47 which abuts against the link arm 34 is fixed to the left end portion of the longitudinal moving table 46. The longitudinal moving table 46 is biased toward its left end portion by a spring mechanism (not shown) so that the roller mechanism 47 always abuts against the link arm 34.

The link arm 34 has a shape symmetrical with respect to the parallel slide table 35 and includes a first inclined portion 34*a* and a second inclined portion 34*b* in the upper and lower end portions, respectively. The first inclined portion 34*a* is inclined counterclockwise through an angle θ1 of 22.5° in the direction perpendicular to the feed direction F of the wire W. The second inclined portion 34*b* is inclined clockwise through an angle θ2 of 22.5° in the direction perpendicular to the feed direction F of the wire W.

Since the link arm 34 abuts against the longitudinal moving table 46 via the roller mechanism 47, the link arm 34 can vertically move. Thus the link arm 34 transmits the motion of the longitudinal moving table 46 to the parallel slide table 35 and the first and second inclined slide tables 37 and 41.

The link arm 34 moves the parallel slide table 35 and the first and second slide tables 37 and 41 the same distance in connection with the longitudinal movement of the longitudinal moving table 46. For example, when the longitudinal moving table 46 is moved forward a distance x, the link arm 34 moves the parallel slide table 35 and the first and second inclined slide tables 37 and 41 the same distance x.

The parallel slide table 35 and the first and second inclined slide tables 37 and 41 are moved the same distance x for the reason explained below.

Figure 17:
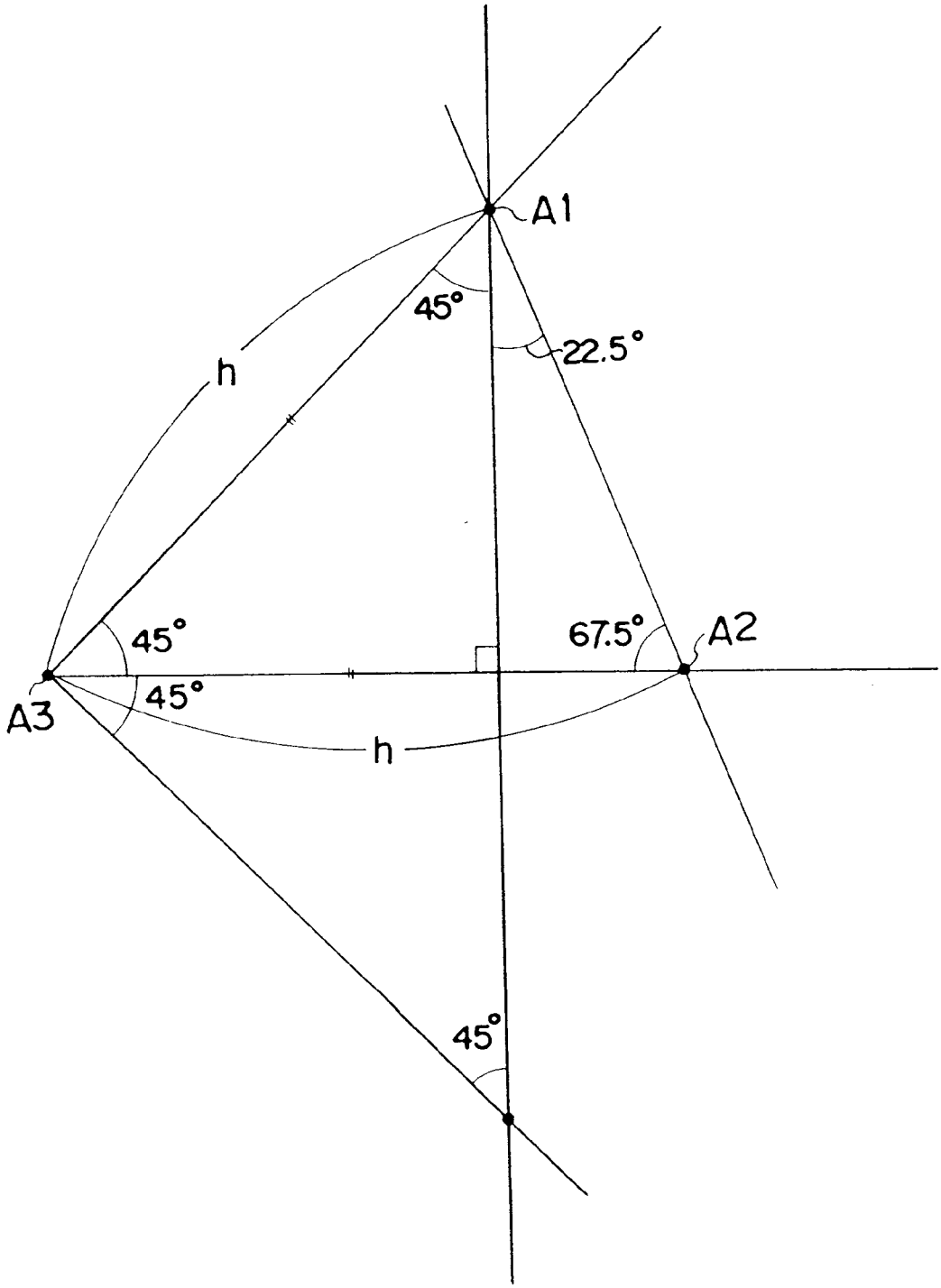
FIG. 17 is a view for explaining the reason why a parallel slide table and first and second inclined slide tables are moved the same distance.

That is, as shown in FIG. 17, letting A1 be the contact point between the first inclined slide table 37 and the first inclined portion 34*a*, A2 be the connecting point between the parallel slide table 35 and the link arm 34, and A3 be the intersection between the tools T1 and T2, a triangle A1-A2-A3 is an isosceles triangle whose sides A1-A3 and A2-A3 have equal lengths. In other words, the link arm 34, the parallel slide table 35, and the first inclined slide table 37 are moved on the vertical moving table 31 while the isosceles triangle A1-A2-A3 described above is always held. Therefore, if a length h of the side A2-A3 which corresponds to the longitudinal moving amount of the link arm 34 changes, the length of the side A1-A3 which corresponds to the moving amount of the first inclined slide table also changes by the same amount h accordingly. This also holds true for the second inclined slide table 41.

Figure 15A:
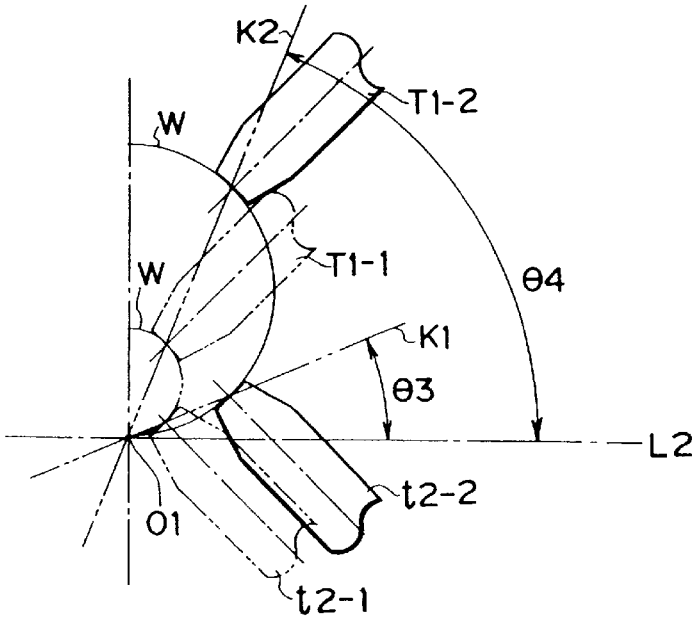
FIG. 15A is a view showing the loci of point tools moved in accordance with the coil diameter when a right hand coil is formed by using two point tools.

As shown in FIG. 15A, the link arm 34 has a function of moving the first and second inclined slide tables 37 and 41 in accordance with a desired wire diameter so that the locus of the end portion of the point tool T1 disposed on the first inclined slide table 37 forms a straight line k2 which intersects a straight line L2 parallel to the feed direction F of the wire W at an angle θ4 of about 67.5°, and the locus of the end portion of the point tool T2 disposed on the second inclined slide table 41 forms a straight line k1 which intersects the straight line L2 parallel to the feed direction F of the wire W at an angle θ3 of about 22.5°.

Figure 14:
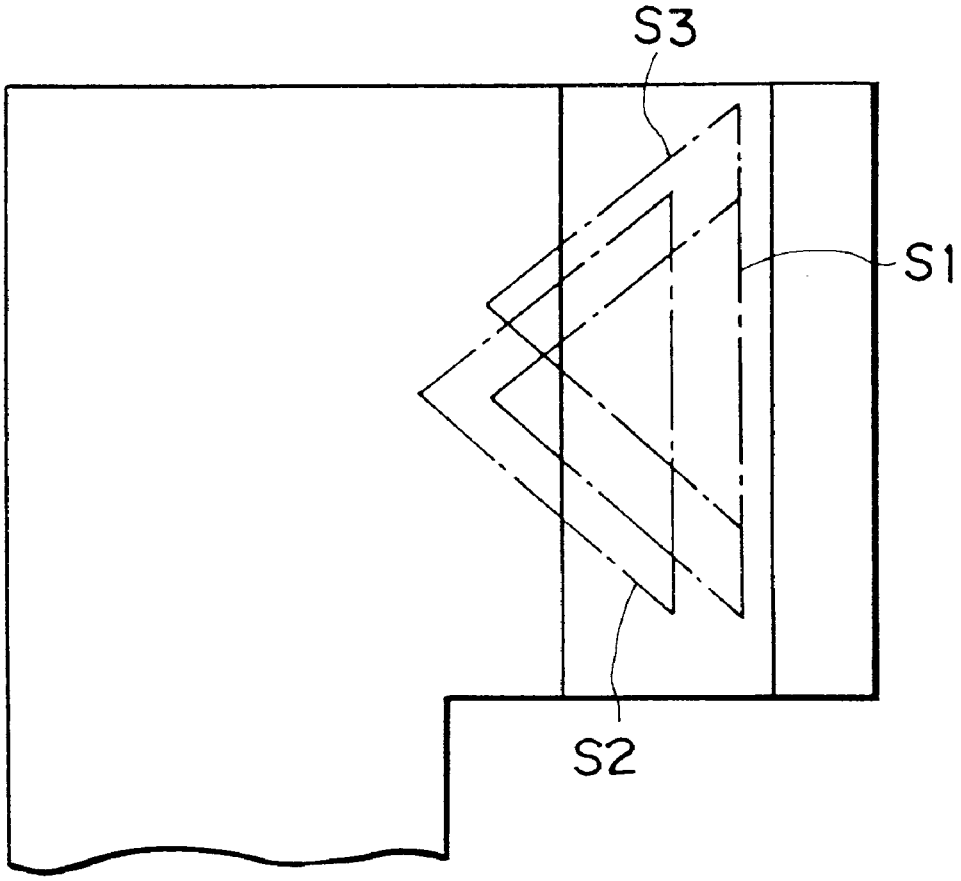
FIG. 14 is a view for explaining the action of a point tool assembly in setting a desired coil wind direction and a desired coil diameter.

As shown in FIG. 14, the longitudinal moving table 31 moves an isosceles triangle S1, formed by connecting central lines along the moving directions of the link arm 34 and the first and second inclined slide tables 37 and 41, in the direction parallel to the forming table surface and the feed direction F of the wire Was indicated by an isosceles triangle S2. Also, the longitudinal moving table 31 moves the isosceles triangle S1, formed by connecting the central lines along the moving directions of the link arm 34 and the first and second inclined slide tables 37 and 41, in the direction parallel to the forming table surface and perpendicular to the feed direction F of the wire W as indicated by an isosceles triangle S3.

[Procedures of changing coil wind direction and coil diameter]

<Twin pin right hand wind>

To form a right hand coil by using two point tools, as shown in FIGS. 2 to 4, the tool fixing blocks 39 and 43 to which the tools T1 and T2 are fixed are mounted on the first and second inclined slide tables 37 and 41, respectively, and no tool is fixed on the parallel slide table 35. The vertical moving table 31 is moved to an upper position P1 in accordance with a desired coil wind direction (in this case, right hand wind). The longitudinal moving table 46 is moved to a predetermined position Q1 in the longitudinal direction in accordance with a desired coil diameter. The distance of the mandrel 103 from the output portion O1 of the wire W is set in accordance with a desired coil diameter. Thus the mandrel 103 is arranged in a predetermined position above the straight line L2 along the feed direction F of the wire W on the forming table.

<Twin pin left hand wind>

To form a left hand coil by using two point tools by changing the wind direction of a right hand coil from the state in which twin pin right hand wind is set as described above, as shown in FIGS. 5 to 7, the vertical moving table 31 is moved to a lower position P2 in accordance with a desired coil wind direction (in this case, left hand wind) from the state shown in FIGS. 2 to 4, and the longitudinal moving table 46 is left unmoved from the position Q1 shown in FIG. 4. The distance of the mandrel 103 from the output portion O1 of the wire W is set in accordance with a desired coil diameter. Thus the mandrel 103 is arranged in a predetermined position below the straight line L2 along the feed direction F of the wire W on the forming table.

Note that when the coil diameter is also changed, it is only necessary to move the longitudinal moving table 46 forward or backward in accordance with a desired coil diameter.

Figure 5:
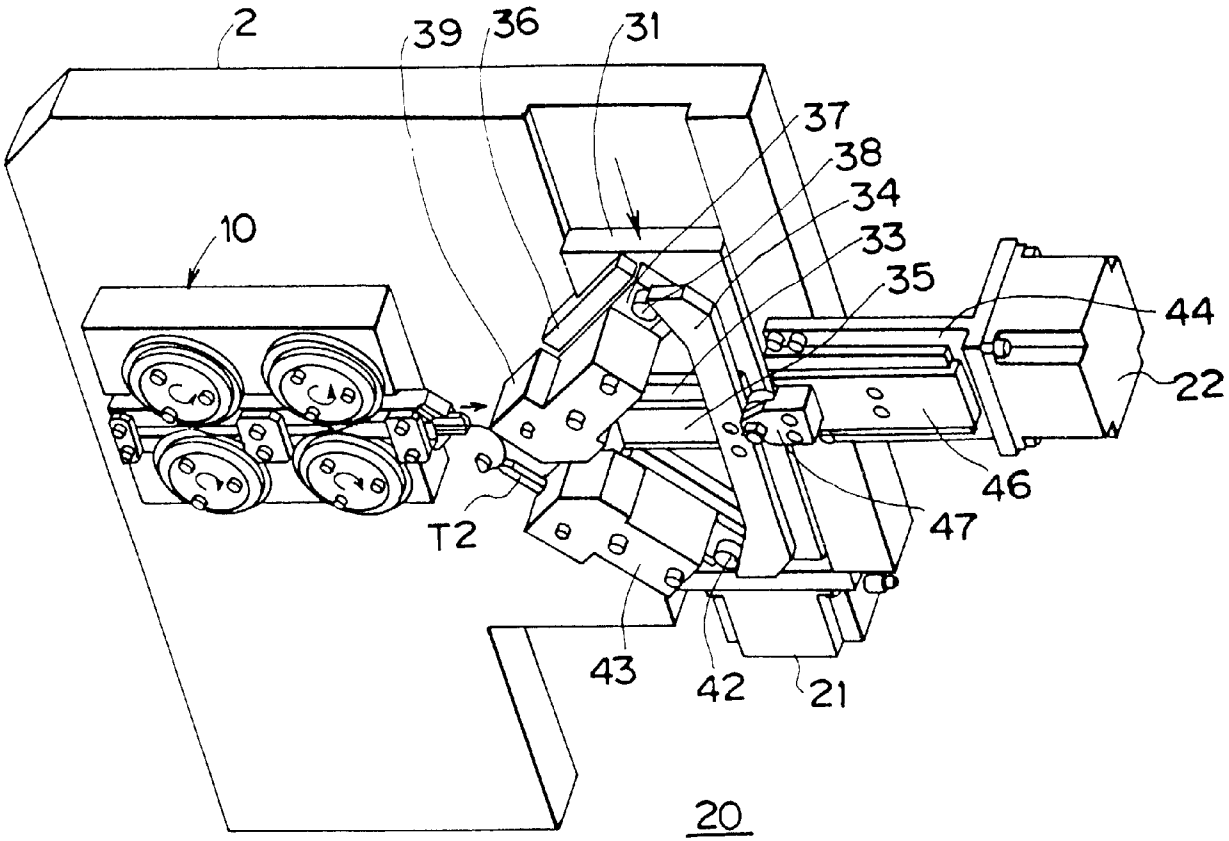
FIG. 5 is a perspective view showing a coiling assembly when the coil wind direction is changed to left hand wind from the state shown in FIG. 1.
Figure 6:
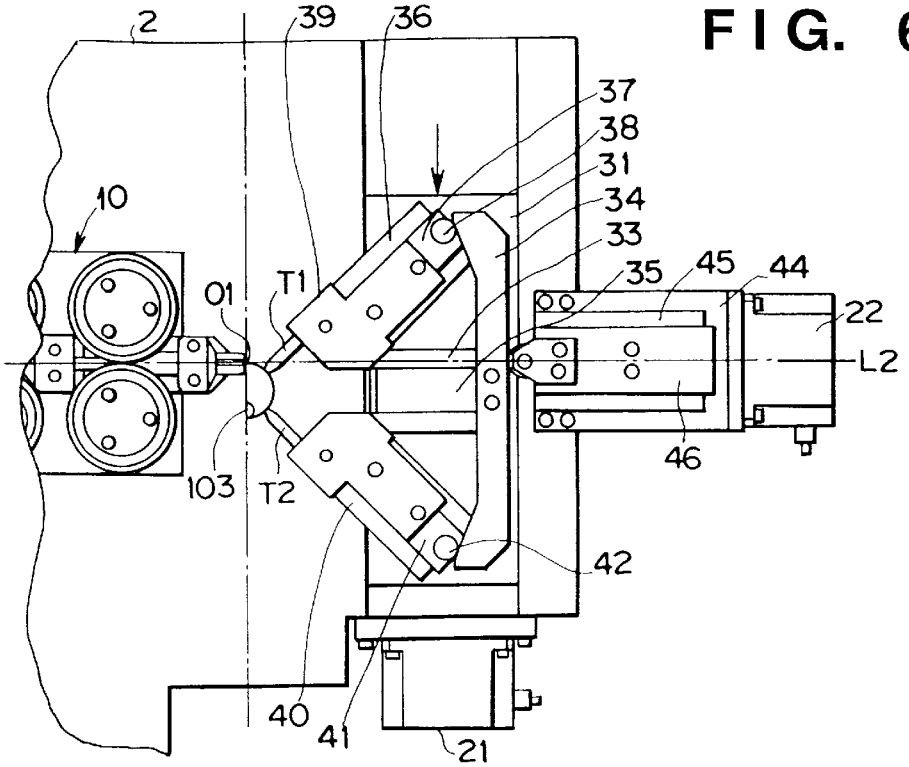
FIG. 6 is a front view showing a part of FIG. 5 in detail.
Figure 7:
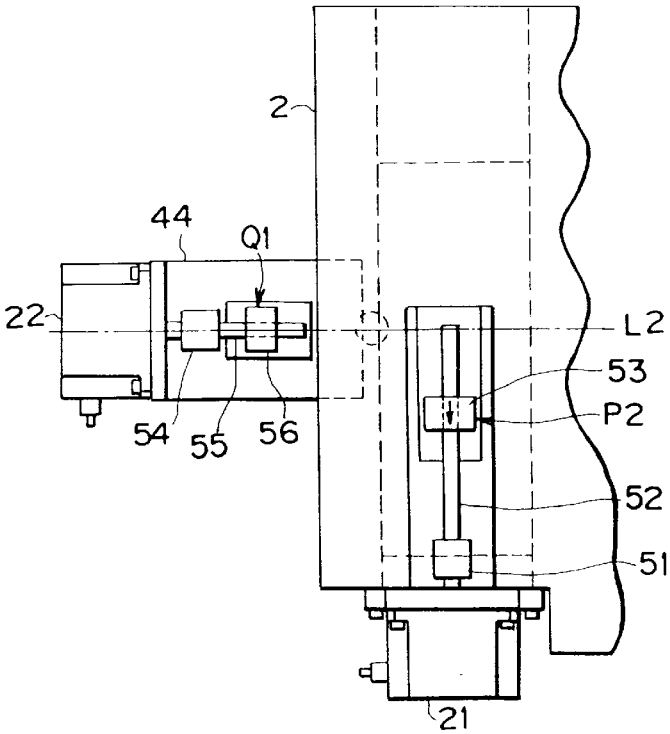
FIG. 7 is a rear view of FIG. 6.

Note also that the same reference numerals as in FIGS. 2 to 4 denote the same parts in FIGS. 5 to 7, and a detailed description thereof will be omitted.

<Single pin right hand wind>

Figure 8:
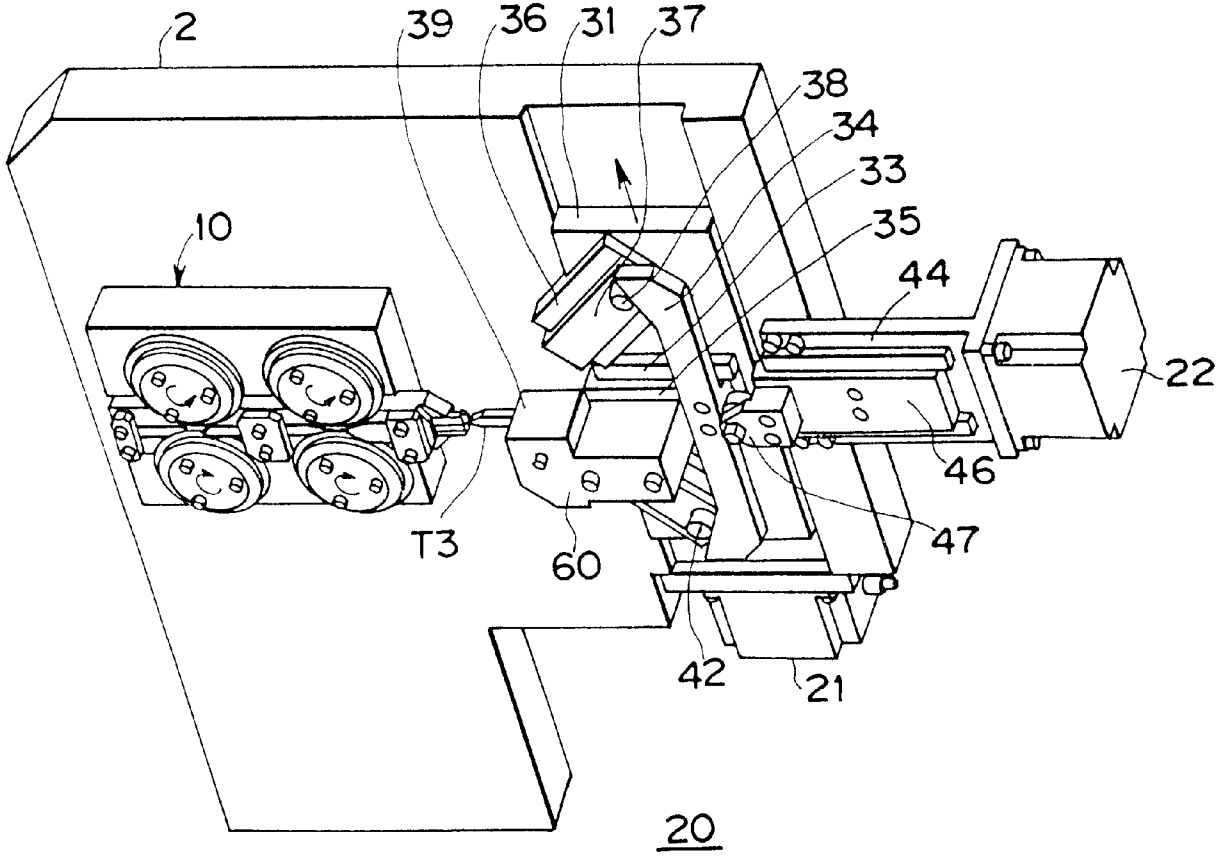
FIG. 8 is a perspective view showing a coiling assembly for forming a right hand coil by using one point tool.
Figure 9:
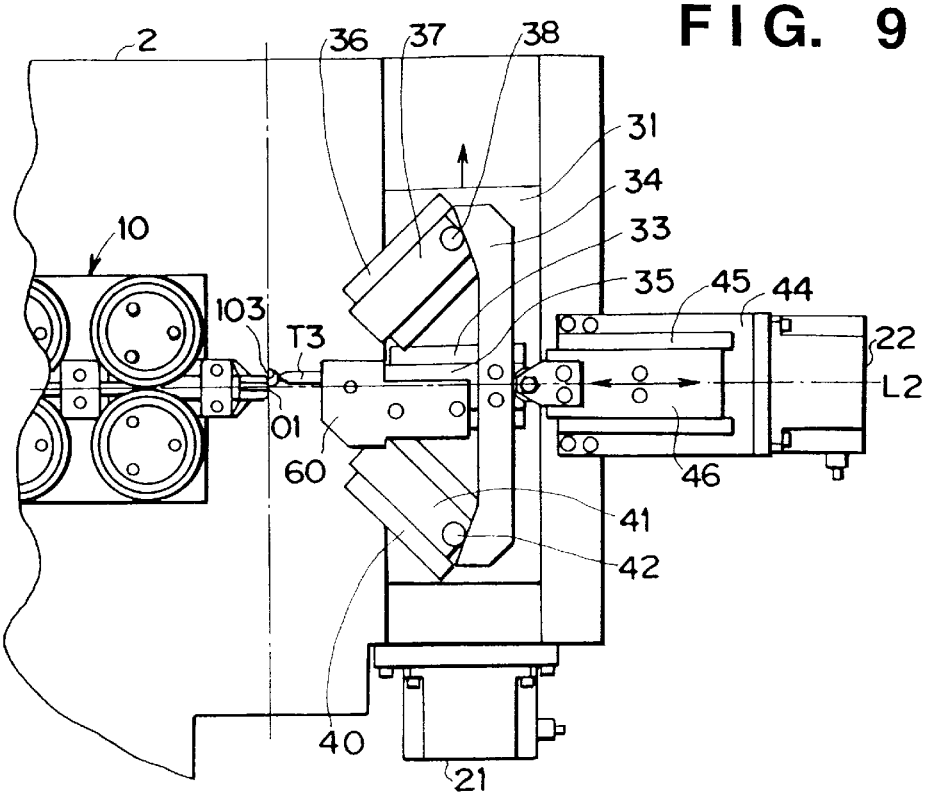
FIG. 9 is a front view showing a part of FIG. 8 in detail.
Figure 10:
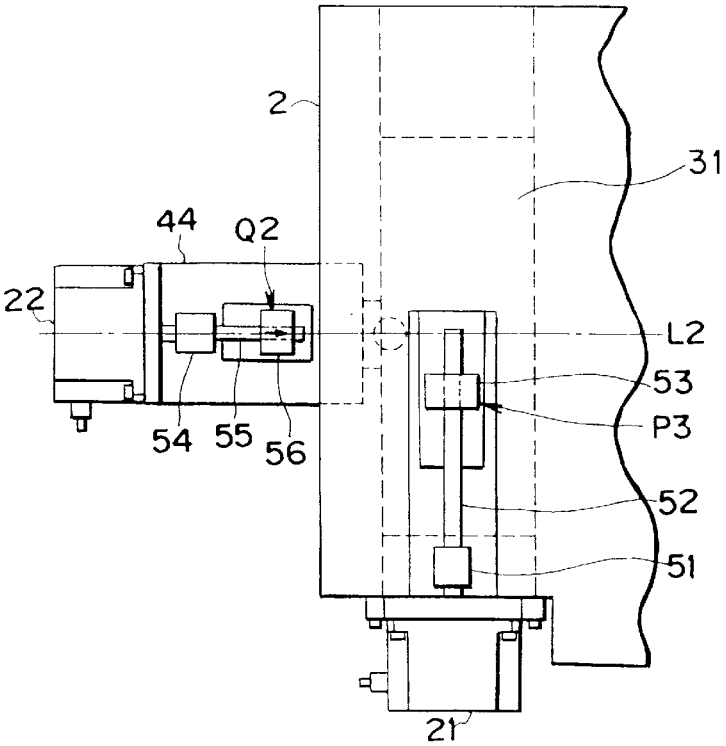
FIG. 10 is a rear view of FIG. 9.

To form a right hand coil by using one point tool, as shown in FIGS. 8 to 10, the tool fixing block 60 to which the tool T3 is fixed is mounted on the parallel slide table 35, and no tools are fixed on the first and second inclined slide tables 37 and 41. The tool fixing block 60 and the tool T3 have the same constructions as the tool fixing blocks 39 and 43 and the point tools T1 and T2, respectively. The vertical moving table 31 is moved to an upper position P3 in accordance with a desired coil wind direction (in this case, right hand wind). The longitudinal moving table 46 is moved to a predetermined position Q2 in the longitudinal direction in accordance with a desired coil diameter. The distance of the mandrel 103 from the output portion O1 of the wire W is set in accordance with a desired coil diameter. Thus the mandrel 103 is arranged in a predetermined position above the straight line L2 along the feed direction F of the wire W on the forming table.

Note that the same reference numerals as in FIGS. 2 to 4 denote the same parts in FIGS. 8 to 10, and a detailed description thereof will be omitted.

<Single pin left hand wind>

To form a left hand coil by using one point tool by changing the wind direction of a right hand coil from the state in which single pin right hand wind is set as described above, as shown in FIGS. 11 to 13, the vertical moving table 31 is moved to a lower position P4 in accordance with a desired coil wind direction (in this case, left hand wind) from the state shown in FIGS. 8 to 10, and the longitudinal moving table 46 is left unmoved from the position Q2 shown in FIG. 10. The distance of the mandrel 103 from the output portion O1 of the wire W is set in accordance with a desired coil diameter. Thus the mandrel 103 is arranged in a predetermined position below the straight line L2 along the feed direction F of the wire W on the forming table.

Note that when the coil diameter is also changed, it is only necessary to move the longitudinal moving table 46 forward or backward in accordance with a desired coil diameter. The number of point tools (single pin or twin pins) used in coil formation can be changed in accordance with the coil diameter of a spring or the shape of the mandrel. For example, the use of one point tool is preferable when the coil diameter is small (when the coil outside diameter is 20 mm or less). Conversely, the use of two point tools is preferable when the coil diameter is large (when the coil outside diameter is 40 mm or more).

Figure 11:
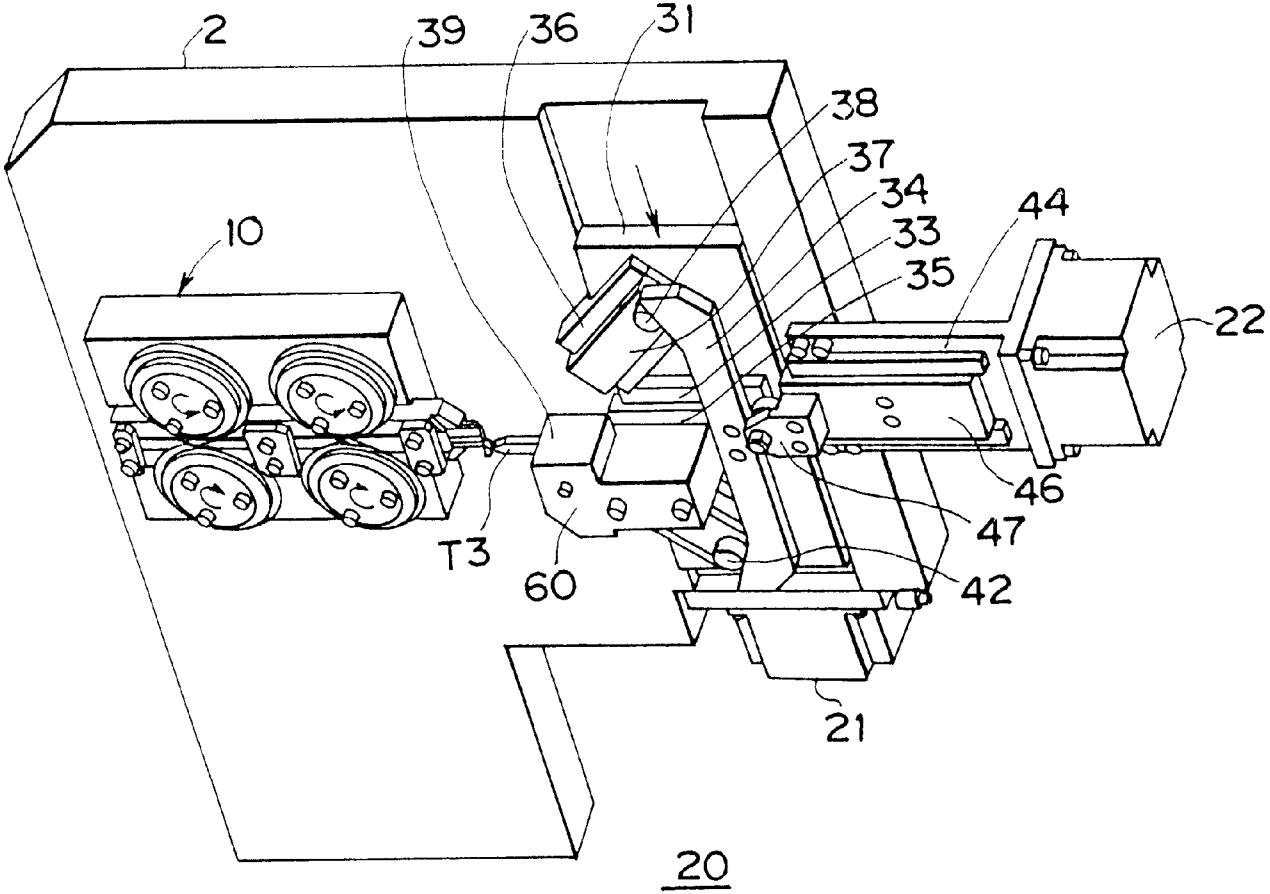
FIG. 11 is a perspective view showing a coiling assembly when the coil wind direction is changed to left hand wind from the state shown in FIG. 8.
Figure 12:
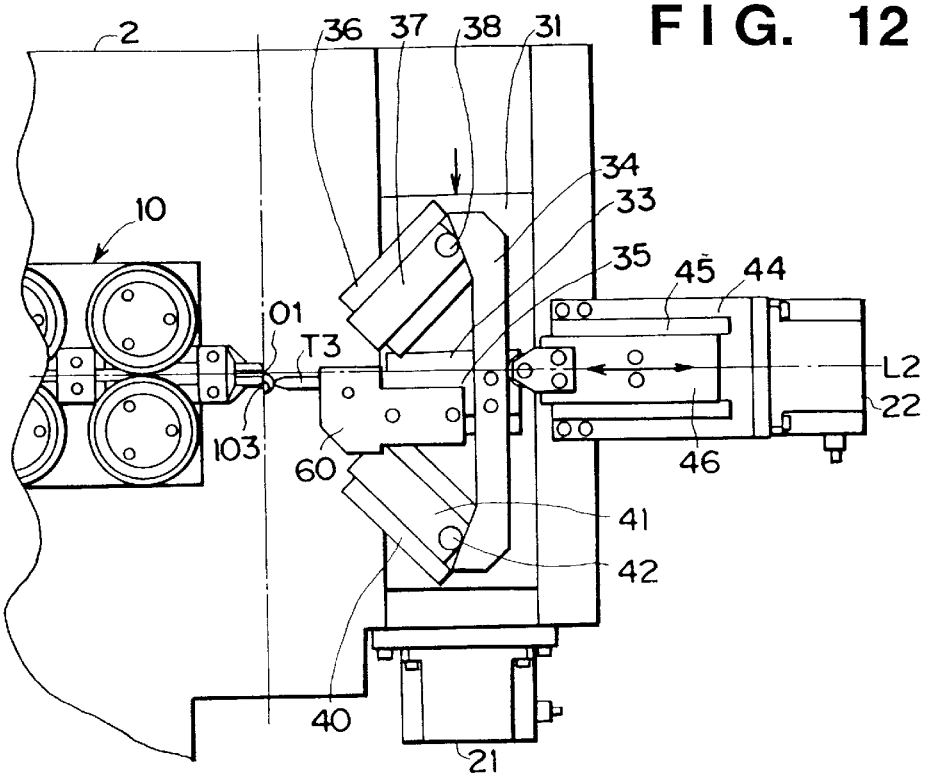
FIG. 12 is a front view showing a part of FIG. 11 in detail.
Figure 13:
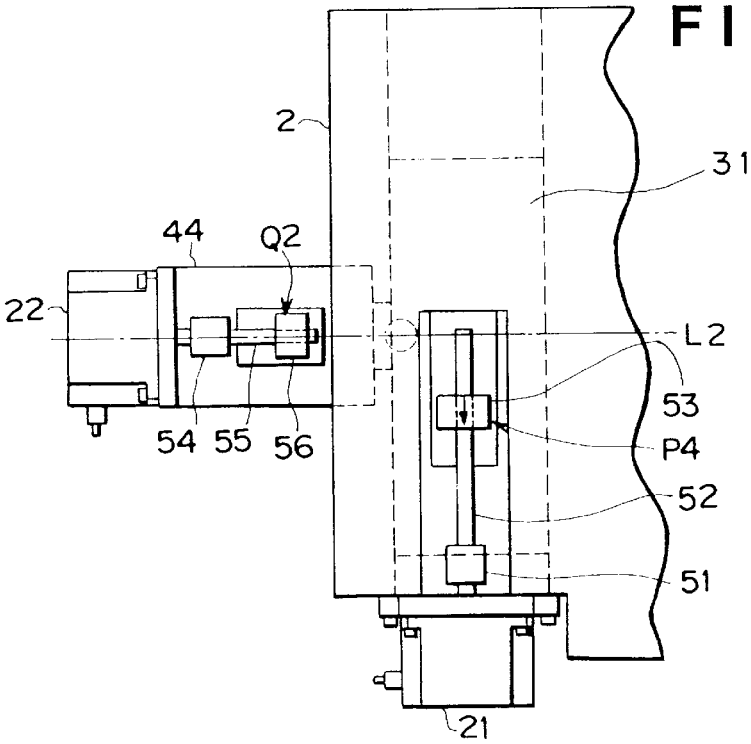
FIG. 13 is a rear view of FIG. 12.

Note also that the same reference numerals as in FIGS. 2 to 4 denote the same parts in FIGS. 11 to 13, and a detailed description thereof will be omitted.

FIG. 15A is a view showing the loci of point tools moved in accordance with the coil diameter when a right hand coil is formed by using two point tools.

To increase the coil diameter, for example, point tools T1-1 and T2-1 are moved to point tools T1-2 and T2-2, respectively. As shown in FIG. 15A, the vertical moving table 31 and the longitudinal moving table 46 are moved in accordance with a desired wire diameter so that the locus of the end portion of the point tool T1 disposed on the first inclined slide table 37 forms the straight line k2 which intersects the straight line L2 parallel to the feed direction F of the wire W at the angle θ4 of about 67.5°, and the locus of the end portion of the point tool T2 disposed on the second inclined slide table 41 forms the straight line k1 which intersects the straight line L2 parallel to the feed direction F of the wire W at the angle θ3 of about 22.5°.

Figure 15B:
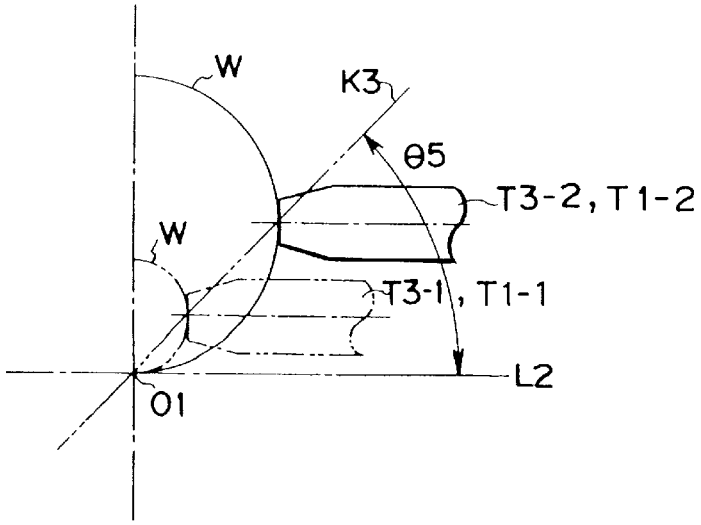
FIG. 15B is a view showing the locus of a point tool moved in accordance with the coil diameter when a right hand coil is formed by using one point tool.

FIG. 15B is a view showing the locus of a point tool moved in accordance with the coil diameter when a right hand coil is formed by using one point tool.

To increase the coil diameter, for example, a point tool T3-1 is moved to a point tool T3-2. As shown in FIG. 15B, the vertical moving table 31 and the longitudinal moving table 46 are moved in accordance with a desired wire diameter so that the locus of the end portion of the point tool T3 disposed on the parallel slide table 35 forms a straight line K3 which intersects the straight line L2 parallel to the feed direction F of the wire W at an angle θ5 of approximately 45°.

Note that in the procedures of changing the coil wind direction and the coil diameter described above, a control block shown in FIG. 16 (to be described later) controls the driving operations by the driving motor 21 of the vertical moving table 31 and the driving motor 22 of the longitudinal moving table 46.

As described above, when the wind direction, the coil diameter, or the like of a coil is to be changed, the point tool assembly of this embodiment allows the relative positional relationship to be easily adjusted without removing the point tool assembly from the forming table, while the tip shape of a tool or the like is changed where necessary.

Also, in setting or changing the wind direction, the coil diameter, or the like of a coil, a new coil diameter or the like can be readily set only by moving the relative positional relationship between point tools longitudinally and laterally.

[Control circuit configuration]

The control circuit configuration of the spring manufacturing machine 100 will be described below.

Figure 16:
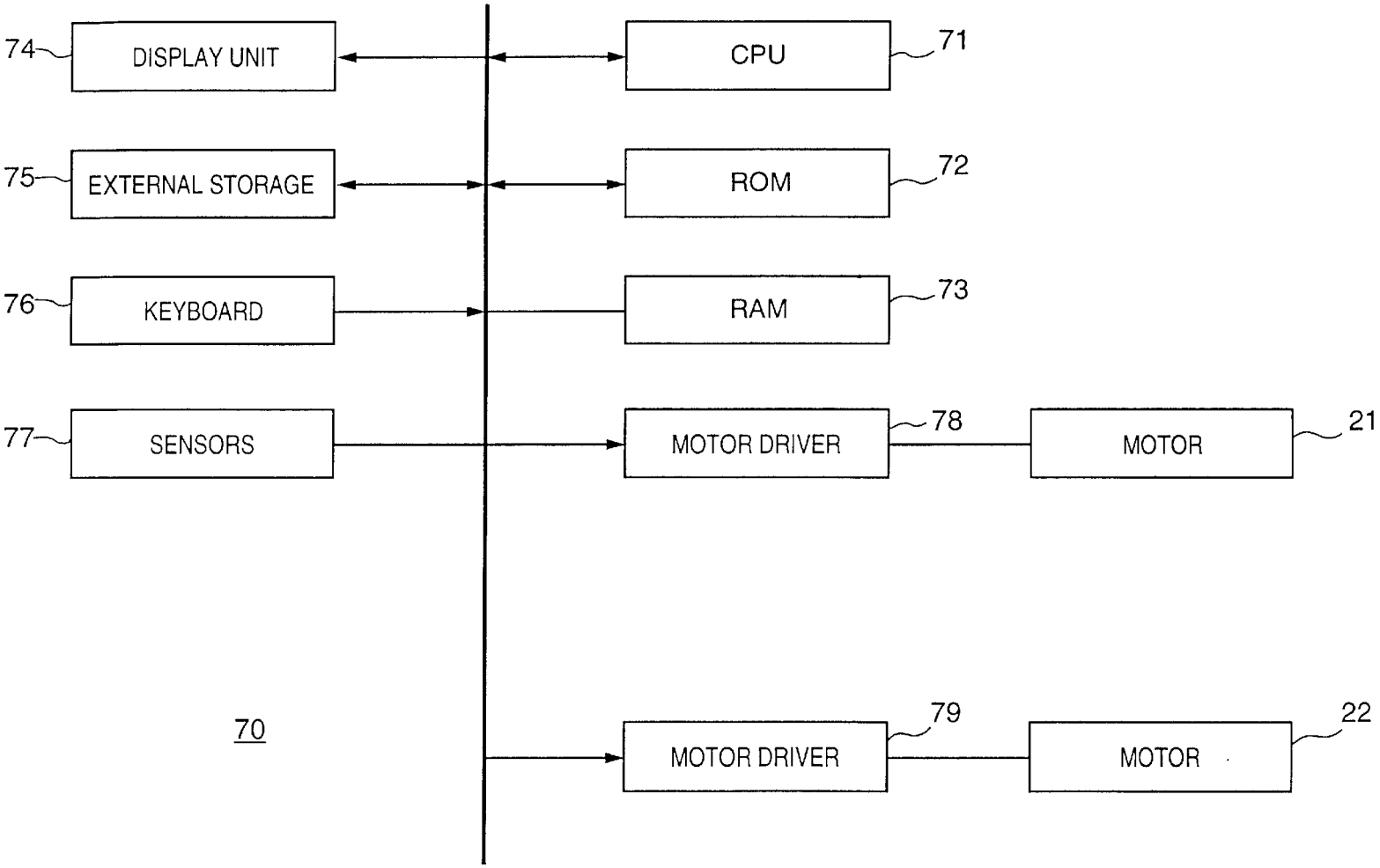
FIG. 16 is a block diagram showing the relationship between a point tool assembly 30 and a controller 70 of the spring manufacturing machine.

FIG. 16 is a block diagram showing the relationship between the point tool assembly 30 and the controller 70 of the spring manufacturing machine.

As shown in FIG. 16, a CPU 71 controls the entire controller 70. A ROM 72 stores the contents (programs) of processing of the CPU 71, various font data, and the like. A RAM 73 is used as the work area of the CPU 71. A display unit 74 is used to perform various settings, display the setting contents, and display the process of manufacture and the like in the form of graphs. An external storage 75 is a floppy disk drive or the like and used to externally supply programs or store the contents of various settings for wire formation processing. Consequently, when parameters for certain processing (e.g., the free length and the diameter in the case of a spring) are stored in a floppy disk, springs having the same shape can be manufactured at any time by setting and executing this floppy disk.

A keyboard 76 is used to set various parameters. Sensors 77 are used to sense the feed amount of a wire and the free length and the like of a spring.

The vertical driving motor 21 and the longitudinal driving motor 22 are driven by corresponding motor drivers 78 an 79, respectively.

In this control block, in accordance with input instructions from the keyboard 76, the CPU 71 drives, e.g., various tool driving motors and driving motors for the upstream and downstream feed rollers independently of each other, in addition to the vertical driving motor 21 and the longitudinal driving motor 22, controls input/output operations with respect to the external storage, and also controls the display unit 74.

Since the control block described above controls the vertical driving motor 21 and the longitudinal driving motor 22, the relative positional relationship between the point tools can be automatically adjusted only by setting or changing the parameters such as the wind direction, the coil diameter, and the like of a coil.

The present invention is applicable to an alteration or a modification of the above embodiment without departing from the gist of the invention.

For example, a single pin dedicated machine including only the parallel slide table 35 can be constructed by removing the first and second inclined slide tables 37 and 41 from the point tool assembly 30 shown in FIG. 3. Alternatively, a twin pin dedicated machine including the first and second inclined slide tables 37 and 41 can also be constructed, although a slide mechanism similar to the parallel slide table 35 is necessary.

Furthermore, the above embodiment is naturally applicable to, e.g., a cutting tool, a wedge tool, and a push tool, as well as to a point tool.

[Effects]

In the first embodiment as described above, when the wind direction, the coil diameter, or the like of a coil is to be changed, the relative positional relationship can be readily adjusted without removing the point tool assembly from the forming table, while the tip shape of a tool or the like is changed where necessary.

Additionally, in setting or changing the wind direction, the coil diameter, or the like of a coil, a new coil diameter or the like can be easily set only by moving the relative positional relationship between point tools longitudinally and laterally.

[Second Embodiment]

[Outline of whole spring apparatus]

Figure 18:
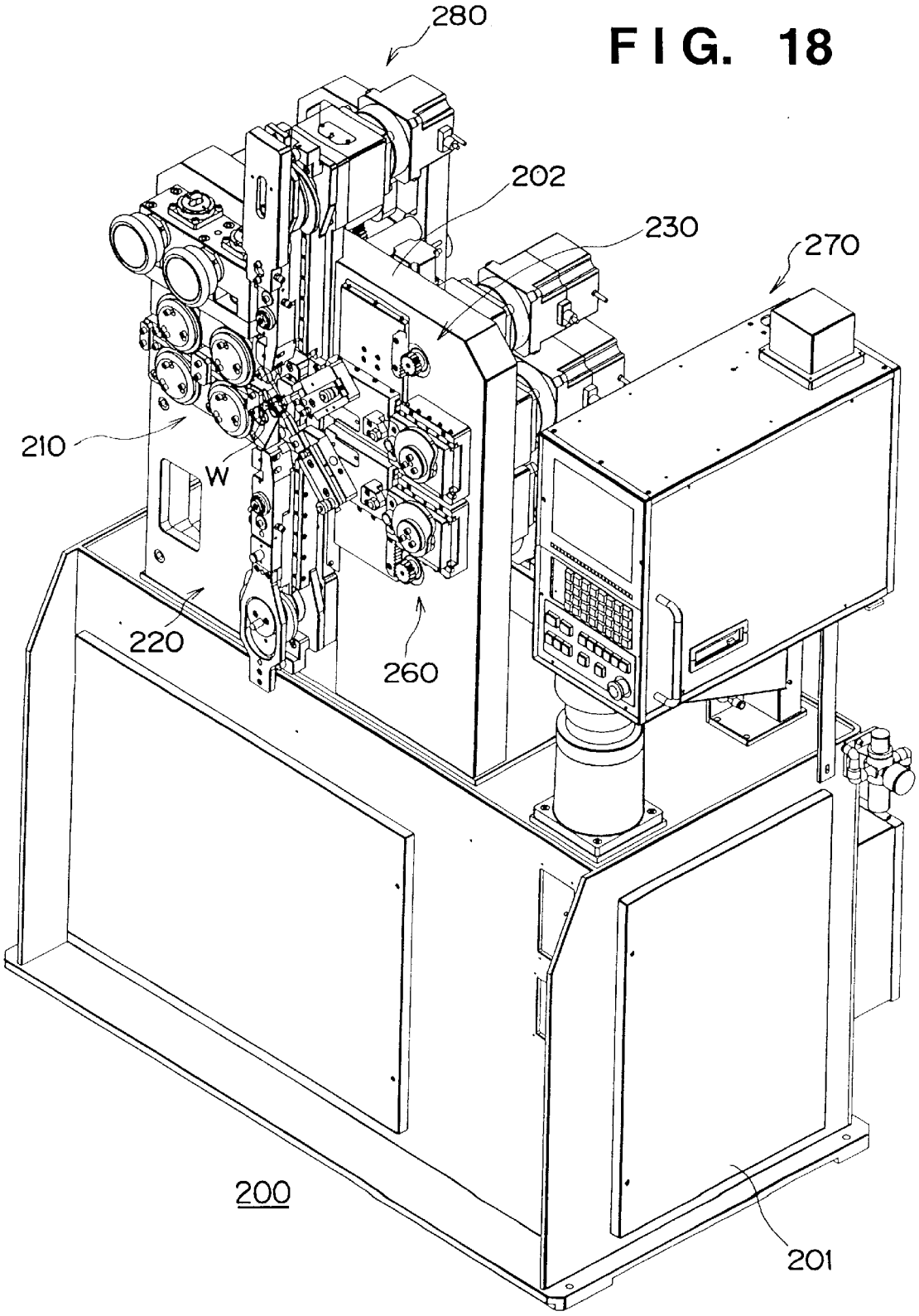
FIG. 18 is a perspective front view showing the whole arrangement of a spring manufacturing apparatus according to another embodiment of the present invention.
Figure 19:
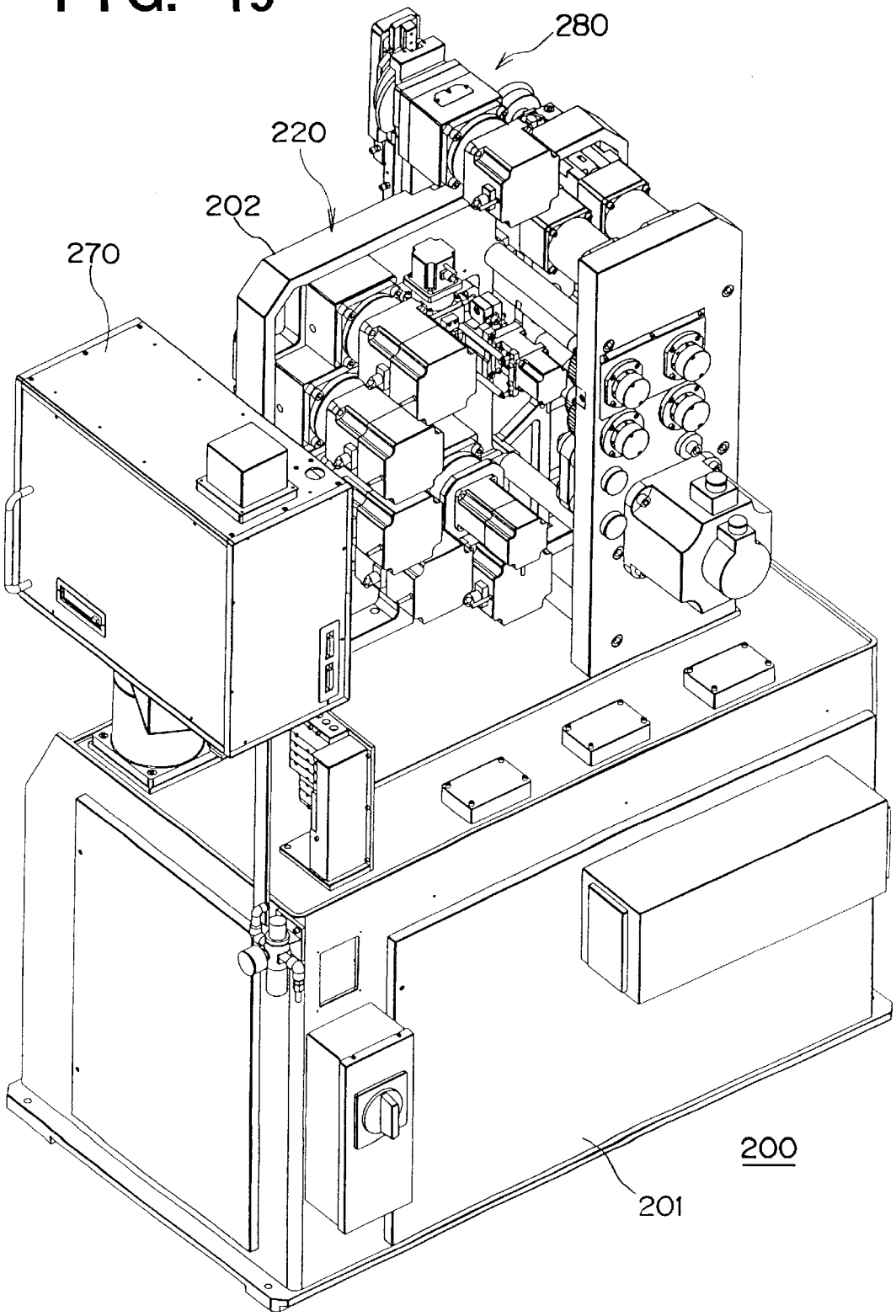
FIG. 19 is a perspective rear view of FIG. 18.
Figure 20:
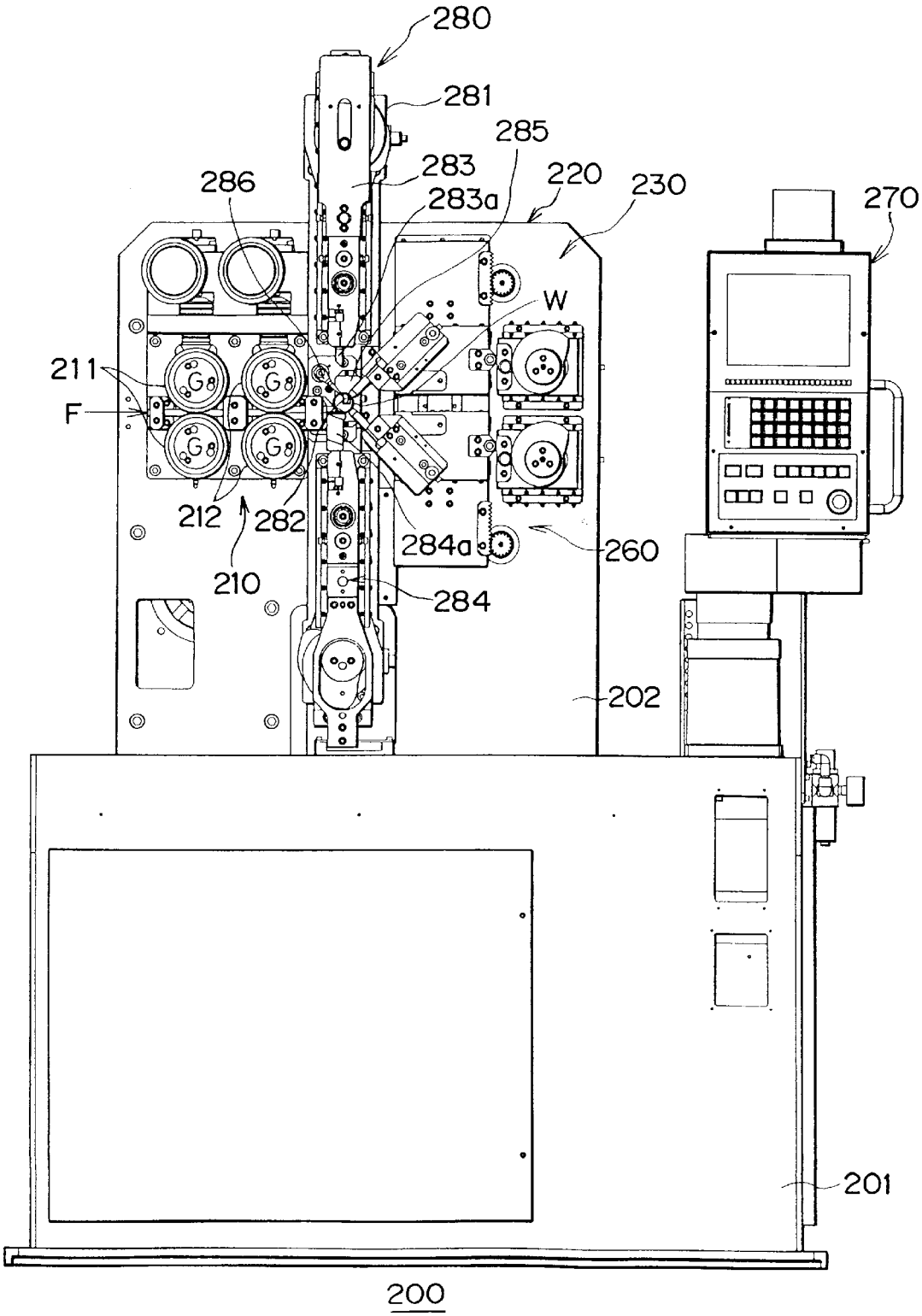
FIG. 20 is a front view of FIG. 18.
Figure 21:
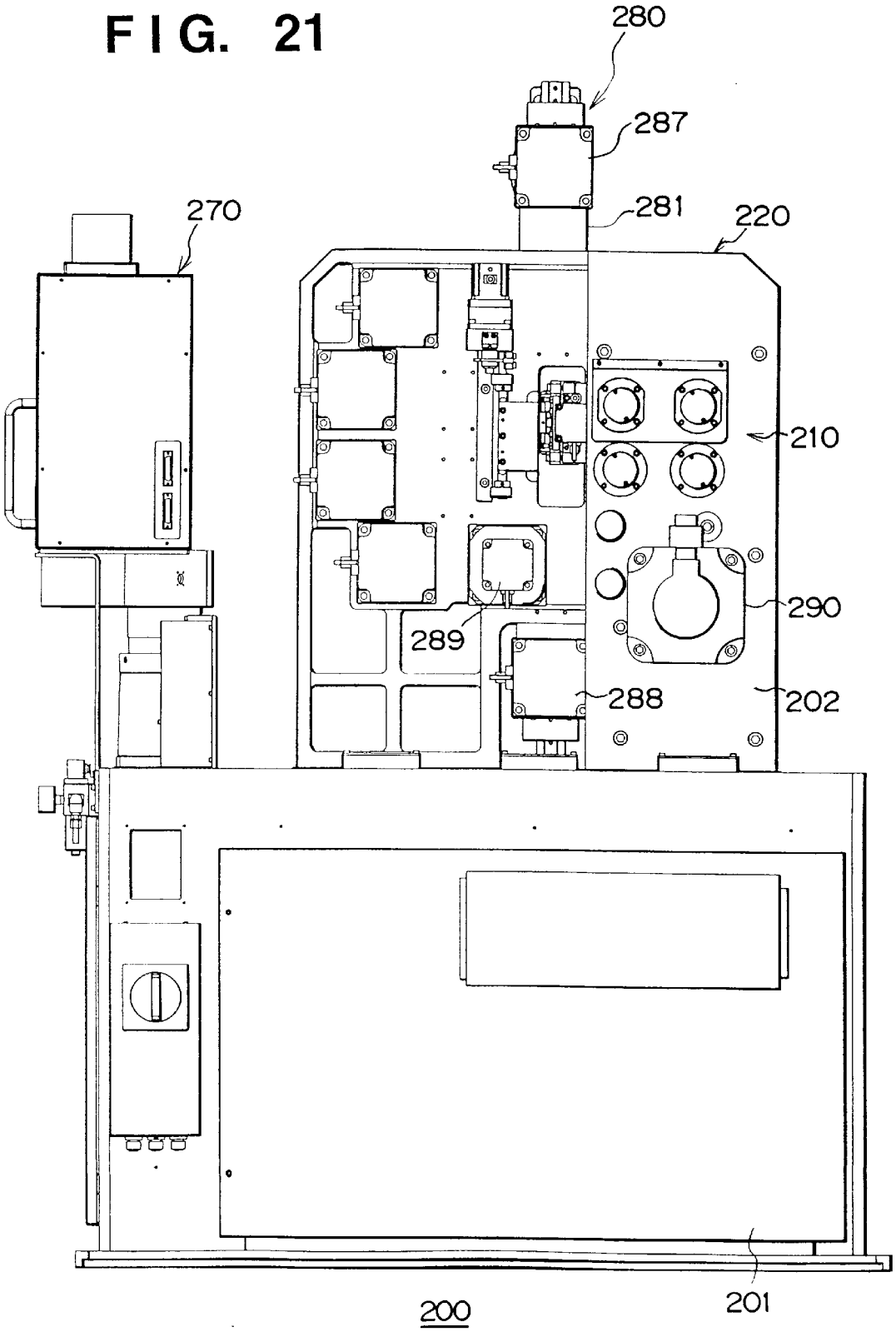
FIG. 21 is a front view of FIG. 19.

FIG. 18 is a schematic front view of a spring manufacturing apparatus according to another embodiment of the present invention. FIG. 19 is a perspective rear view of FIG. 18. FIG. 20 is a front view of FIG. 18. FIG. 21 is a front view of FIG. 19.

As shown in FIGS. 18 to 21, a spring manufacturing apparatus 200 of this embodiment is an apparatus for forming a helical compression spring having, e.g., a conical shape, an hourglass shape, or a barrel shape by giving a predetermined coil diameter and a predetermined pitch to a wire being fed. However, it is of course possible to form a helical tension spring or a helical torsion spring.

This spring manufacturing apparatus 200 comprises a box-like machine main body 201, a coil forming apparatus 220 mounted on the upper surface of the machine main body 201, a wire supply apparatus (not shown) for supplying a wire W to the coil forming apparatus 220, and a controller 270 for controlling the entire machine.

As will be described later, the coil forming apparatus 220 comprises a forming table 202, a feed unit 210 for feeding the wire W to the forming table 202, a first tool drive unit 230 for movably supporting a first point tool on the forming table, a second tool drive unit 260 for movably supporting a second point tool on the forming table, and a cutting and wedge tool drive unit 280 for movably supporting a cutting tool, a wedge tool, and a push tool.

The coil forming apparatus 220 has functions of feeding the wire W by the feed unit 210, forcedly curving the fed wire W by the first and/or second point tools, growing a coil by a predetermined coil diameter and a predetermined pitch by using the wedge tool and the push tool, and forming a coil spring by cutting the coil finally formed into a desired shape by the cutting tool.

As shown in FIGS. 20 and 21, the cutting and wedge tool drive unit 280 comprises a long and narrow base 281, a mandrel 282 disposed in substantially the center of this base 281, and a cutting tool mechanism 283 and a wedge tool mechanism 284 slidably mounted on the base 281.

The cutting tool mechanism 283 and the wedge tool mechanism 284 are so arranged as to oppose each other in the vertical direction with respect to the semicircular mandrel 282 and can slide toward the mandrel 282. The mandrel 282 is fixed on a mandrel pedestal 285 projecting from nearly the center of the base 281. A push tool 286 is disposed on the base 281 in the vicinity of the mandrel 282. The base 281 can be vertically moved by numerical control by a base driving motor 289 via a rack and pinion mechanism (not shown) disposed on the rear surface the forming table 202. A cutting tool driving motor 287 for driving a cutting tool 283*a* is disposed behind the upper end portion of the base 281. In addition, a wedge tool driving motor 288 for driving a wedge tool 284*a* is disposed behind the lower end portion of the base 281.

In the cutting and wedge tool drive unit 280, the mandrel 282 is arranged in roughly the center of the forming table 202, the cutting tool mechanism 283 and the wedge tool mechanism 284 are arranged along the vertical direction of the forming table 202, and the push tool 286 is arranged on the base 281 in the vicinity of the mandrel 282.

[Details of coil forming apparatus]

Details of the coil forming apparatus 220 will be described below.

As shown in FIG. 20, the forming table 202 fixed to the machine main body 201 is the base of the coil forming apparatus 220. This forming table 202 is made of, e.g., a rectangular metal material having a plate thickness by which predetermined strength is obtained, and supports the feed unit 10, the first tool drive unit 230, the second tool drive unit 260, and the cutting and wedge tool drive unit 280. The forming table 202 forms a plane parallel to the feed direction of the wire W, and this plane defines a spring formation space.

The feed unit 210 includes a pair of upper and lower upstream feed rollers 211 and a pair of upper and lower downstream feed rollers 212 for feeding the wire W in the feed direction (from left to right in the plane of the paper of FIG. 20). These upstream feed rollers 211 and downstream feed rollers 212 are rotated at a rotational speed corresponding to a predetermined feed speed or amount by a feed roller driving motor 290.

When the upstream and downstream feed rollers 211 and 212 are rotated in a feed direction F, the wire W is fed into a spring formation space.

[First tool drive unit]

The first tool drive unit 230 will be described in detail below.

Figure 22:
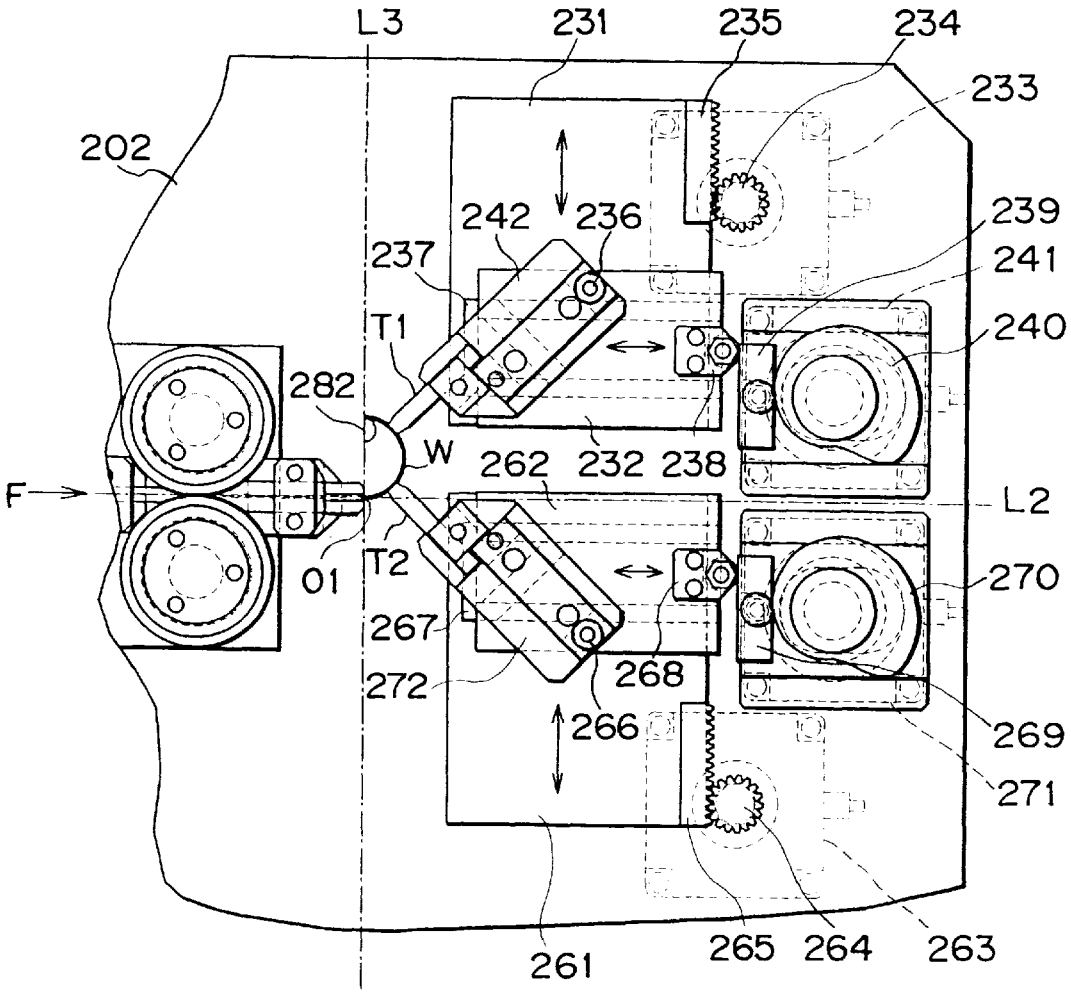
FIG. 22 is a view showing details of a part of a coil forming apparatus in forming a right hand coil by using two point tools.

FIG. 22 is a view showing the coil forming apparatus shown in FIG. 18 and shows details of a part of the coil forming apparatus when a right hand coil is formed by using two point tools.

As shown in FIG. 22, the first tool drive unit includes a first vertical moving table 231 and a first parallel moving table 232 disposed on the forming table 202. The first vertical moving table 231 can move in a direction L3 parallel to the forming table surface and perpendicular to the feed direction F of the wire W. The first parallel moving table 232 can move in a direction L2 parallel to the forming table surface and the feed direction F of the wire W independently of the first vertical moving table 231.

The first vertical moving table 231 can be vertically moved by a first vertical driving motor 233 arranged on the rear surface of the forming table 202. The rotational force of this first vertical driving motor 233 is transmitted to the first vertical moving table 231 by a pinion 234 disposed at the end of the motor shaft and a rack 235 disposed on the first vertical moving table 231.

The first parallel moving table 232 is disposed on the first vertical moving table 231 and can slide in the direction L2 parallel to the forming table surface and the feed direction F of the wire W.

The first parallel moving table 232 is slidably disposed on first parallel slide rails 237 fixed on the first vertical moving table 231. The first parallel moving table 232 and the first parallel slide rails 237 are arranged in the lower end portion with respect to the vertical direction of the first vertical moving table 231. A first tool fixing block 242 is fixed to the first parallel slide table 232, and a first point tool T1 can be attached to the end portion of this first tool fixing block 242.

A first roller mechanism 238 which abuts against the left end portion of a first parallel moving arm 239 is attached to the right end portion of the first parallel moving table 232. The first parallel moving table 232 is biased toward its right end portion by a spring mechanism (not shown) so that the first roller mechanism 238 always abuts against the first parallel moving arm 239.

The first parallel moving arm 239 moves in the same direction as the moving direction of the first parallel moving table 232 by the rotation of a first cam 240. The first cam 240 is rotated by a first cam driving motor 241 disposed on the rear surface of the forming table 202.

Since the first parallel moving arm 239 is pressed against the first parallel moving table 232 via the first roller mechanism 238, the first parallel moving arm 239 can vertically move. Thus the longitudinal movement of the first parallel moving arm 239 is transmitted to the first parallel moving table 232.

Figure 28:
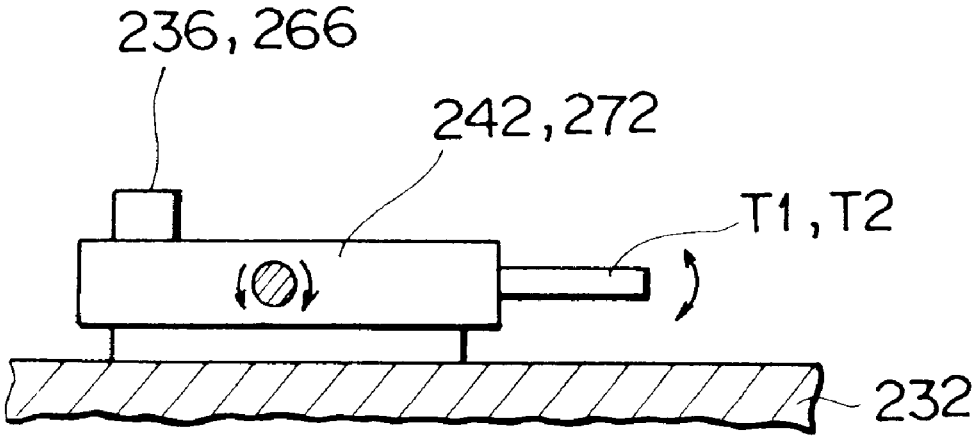
FIG. 28 is a view for explaining the function of a micrometer.

The first tool fixing block 242 is attached to the first parallel moving table 232 so that the first tool fixing block 242 intersects the direction L2 parallel to the feed direction F of the wire W counterclockwise at an angle of 45° around a wire output portion O1 or is parallel to the feed direction F of the wire W. This first tool fixing block 242 includes a micrometer 236. As shown in FIG. 28, the micrometer 236 can finely adjust the end portion of the first point tool T1 so that the end portion moves away from or nearer to the parallel moving table (forming table surface). For example, it is possible to adjust the initial tension (urging force between coil pitches) of a spring (e.g., a helical tension spring) having closely contacting coils.

[Second tool drive unit]

The second tool drive unit 260 will be described in detail below with reference to FIG. 22.

As shown in FIG. 22, the second tool drive unit 260 includes a second vertical moving table 261 and a second parallel moving table 262 disposed on the forming table 202. The second vertical moving table 261 can move in the direction L3 parallel to the forming table surface and perpendicular to the feed direction F of the wire W. The second parallel moving table 262 can move in the direction L2 parallel to the forming table surface and the feed direction F of the wire W independently of the second vertical moving table 261.

The second vertical moving table 261 can be vertically moved by a second vertical driving motor 263 arranged on the rear surface of the forming table 202. The rotational force of this second vertical driving motor 263 is transmitted to the second vertical moving table 261 by a pinion 264 disposed at the end of the motor shaft and a rack 265 disposed on the second vertical moving table 261.

The second parallel moving table 262 is disposed on the second vertical moving table 261 and can slide in the direction L2 parallel to the forming table surface and the feed direction F of the wire W.

The second parallel moving table 262 is slidably disposed on second parallel slide rails 267 fixed on the second vertical moving table 261. The second parallel moving table 262 and the second parallel slide rails 267 are arranged in the upper end portion with respect to the vertical direction of the second vertical moving table 261. A second tool fixing block 272 is fixed to the second parallel slide table 262, and a second point tool T2 can be attached to the end portion of this second tool fixing block 272.

A second roller mechanism 268 which abuts against the left end portion of a second parallel moving arm 269 is attached to the right end portion of the second parallel moving table 262. The second parallel moving table 262 is biased toward its right end portion by a spring mechanism (not shown) so that the second roller mechanism 268 always abuts against the second parallel moving arm 269.

The second parallel moving arm 269 moves in the same direction as the moving direction of the second parallel moving table 262 by the rotation of a second cam 270. The second cam 270 is rotated by a second cam driving motor 271 disposed on the rear surface of the forming table 202.

Since the second parallel moving arm 269 is pressed against the second parallel moving table 262 via the second roller mechanism 268, the second parallel moving arm 269 can vertically move. Thus the longitudinal movement of the second parallel moving arm 269 is transmitted to the second parallel moving table 262.

The second tool fixing block 272 is attached to the second parallel moving table 262 so that the second tool fixing block 272 intersects the direction L2 parallel to the feed direction F of the wire W clockwise at an angle of 45° at the wire output portion O1 or is parallel to the feed direction F of the wire W. This second tool fixing block 272 includes a micrometer 266. As shown in FIG. 28, the micrometer 266 can finely adjust the end portion of the second point tool T2 so that the end portion moves away from or nearer to the parallel moving table (forming table surface). For example, it is possible to adjust the initial tension (urging force between coil pitches) of a spring (e.g., a helical tension spring) having closely contacting coils.

The first tool drive unit 230 and the second tool drive unit 260 are vertically arranged on the forming table 202 so as to be symmetrical with respect to the direction L2 parallel to the wire feed direction F. That is, the first and second tool drive units 230 and 260 are disposed in the upper and lower portions, respectively.

When the first tool fixing block 242 and the second tool fixing block 272 are so attached as to intersect the direction L2 parallel to the feed direction F of the wire W at an angle of 45°, the first and second point tools T1 and T2 are so arranged as to form an angle of 90° around the center of a desired coil diameter and so moved as to converge into the center of a desired coil diameter.

Also, when the first tool fixing block 242 or the second tool fixing block 272 is attached parallel to the feed direction F of the wire W, one or both of the first and second point tools T1 and T2 are used in accordance with the coil diameter.

[Procedures of changing coil wind direction and coil diameter]

In this embodiment, the feed unit 210, the first and second tool drive units 230 and 260, and the cutting and wedge tool drive unit 280 can be numerically controlled independently of each other. Therefore, the positions of the individual tools, the wire feed amount, the cutting timing, and the like can be automatically controlled when the coil diameter or the wind direction is changed or in accordance with the coil shape (e.g., a helical compression spring, a helical tension spring, a full-elliptic spring, a magazine spring, or an hourglass-shaped spring). Practical examples will be described below.

<Twin pin right hand wind>

To form a right hand coil by using the first and second point tools, as shown in FIG. 22, the first tool fixing block 242 and the second tool fixing block 272 are so attached as to intersect the feed direction F of the wire W at an angle of 45°, and the first and second point tools T1 and T2 are attached. The first and second vertical moving tables 231 and 261 are moved upward by driving the first and second vertical driving motors 233 and 263 in accordance with a desired coil wind direction (in this case, right hand wind). The first and second parallel moving tables 232 and 262 are moved to predetermined positions in the longitudinal direction by driving the first and second cam driving motors 241 and 271 in accordance with a desired coil diameter. The distance of the mandrel 282 from the output portion O1 of the wire W is set by driving the base driving motor 289 in accordance with a desired coil diameter. Thus the mandrel 282 is arranged in a predetermined position above the straight line L2 along the feed direction F of the wire W on the forming table.

<Twin pin left hand wind>

Figure 23:
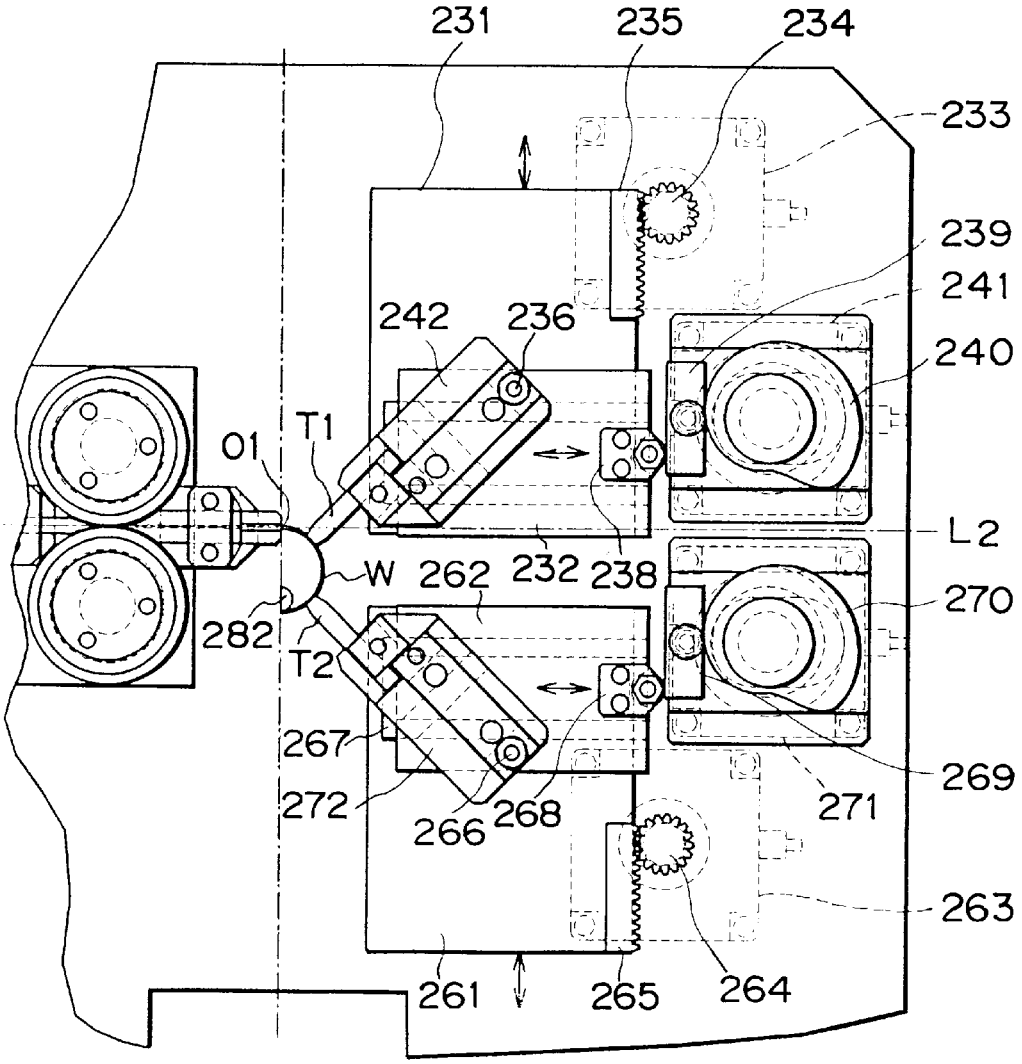
FIG. 23 is a view showing details of the part of the coil forming apparatus in forming a left hand coil by using two point tools.

To form a left hand coil by using the first and second point tools, as shown in FIG. 23, the first tool fixing block 242 and the second tool fixing block 272 are so attached as to intersect the feed direction F of the wire W at an angle of 45°, and the first and second point tools T1 and T2 are attached. The first and second vertical moving tables 231 and 261 are moved downward by driving the first and second vertical driving motors 233 and 263 in accordance with a desired coil wind direction (in this case, left hand wind). The first and second parallel moving tables 232 and 262 are moved to predetermined positions in the longitudinal direction in accordance with a desired coil diameter. The distance of the mandrel 282 from the output portion O1 of the wire W is set by driving the base driving motor 289 in accordance with a desired coil diameter. Thus the mandrel 282 is put in a predetermined position below the straight line L2 along the feed direction F of the wire W on the forming table.

Note that the same reference numerals as in FIG. 22 denote the same parts in FIG. 23, and a detailed description thereof will be omitted.

<Single pin right hand wind>

Figure 24:
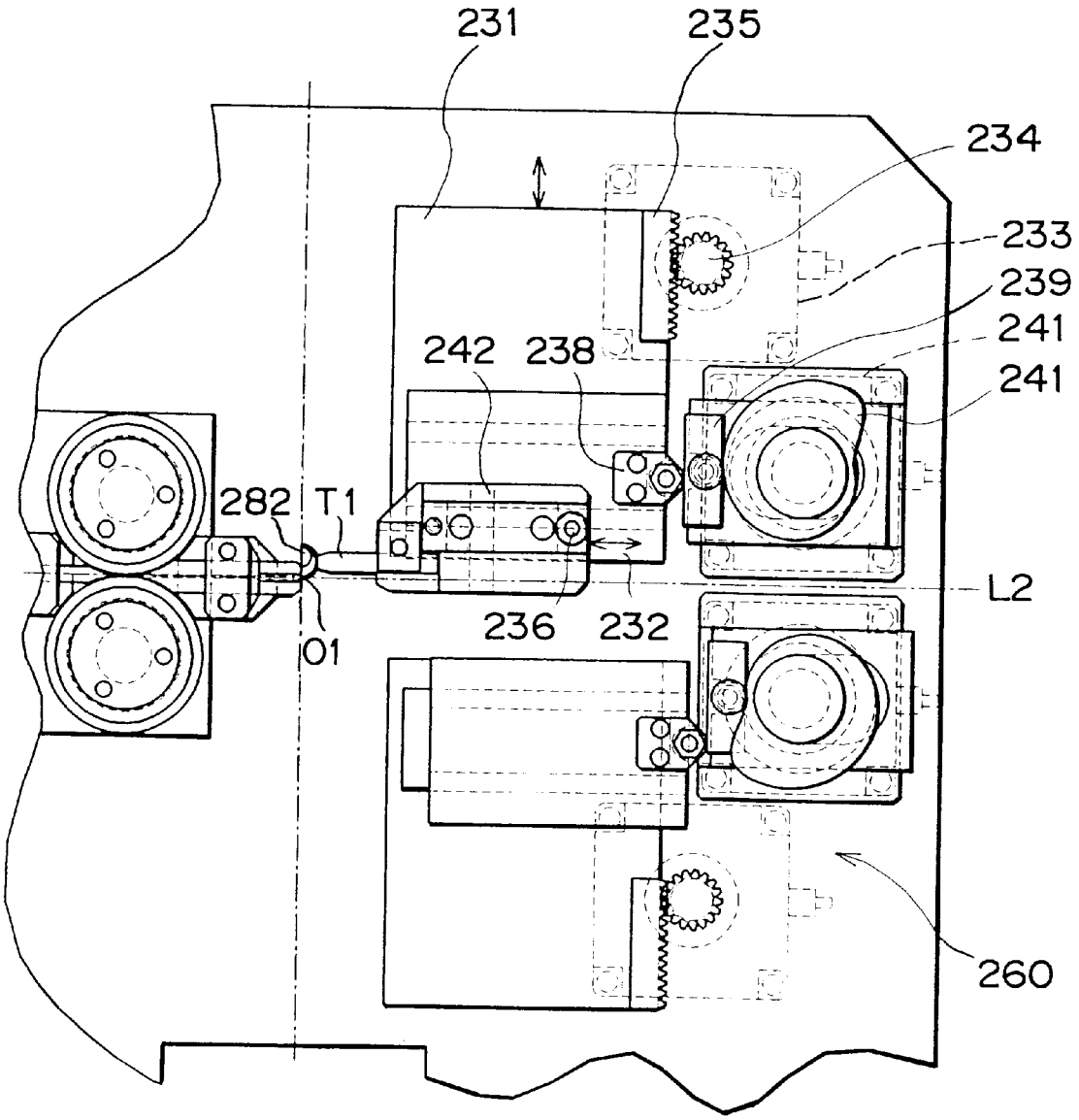
FIG. 24 is a view showing details of the part of the coil forming apparatus in forming a right hand coil by using one point tool.

To form a right hand coil by using the first point tool, as shown in FIG. 24, the first tool fixing block 242 to which the first point tool T1 is attached is mounted, parallel to the straight line L2 along the feed direction F of the wire W, on the first parallel moving table 232. The second vertical moving table 261 of the second tool drive unit 260 is retracted to the lower position without being driven. The second parallel moving table 262 is retracted to the rear position. In this retracted state, the second point tool T2 may or may not be attached to the second tool fixing block 272 of the second tool drive unit 260. The first vertical moving table 231 is moved upward by driving the first vertical driving motor 233 in accordance with a desired coil wind direction (in this case, right hand wind). The first parallel moving table 232 is moved to a predetermined position in the longitudinal direction in accordance with a desired coil diameter by driving the first cam driving motor 241. The distance of the mandrel 282 from the output portion Ol of the wire W is set by driving the base driving motor 289 in accordance with a desired coil diameter. Thus the mandrel 282 is set in a predetermined position above the straight line L2 along the feed direction F of the wire W on the forming table.

Note that the same reference numerals as in FIG. 22 denote the same parts in FIG. 24, and a detailed description thereof will be omitted.

<Single pin left hand wind>

Figure 25:
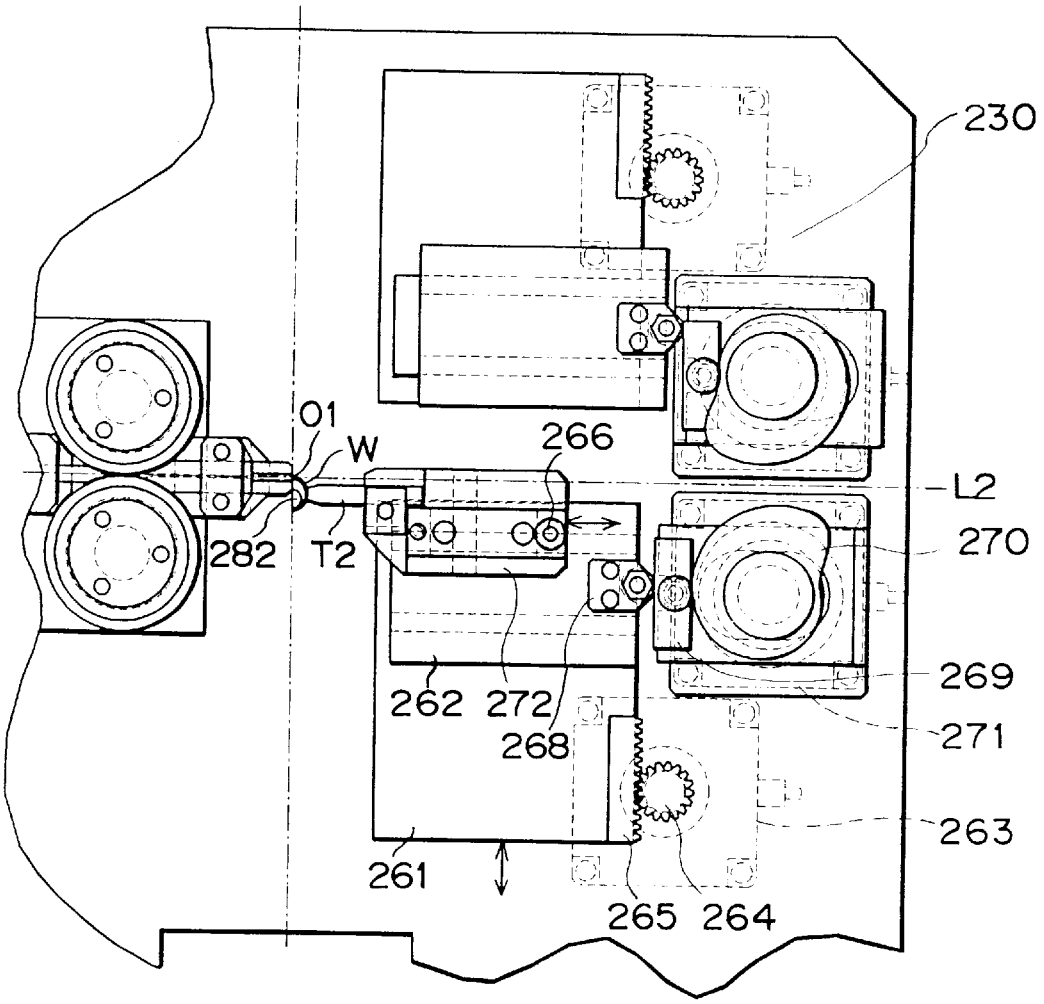
FIG. 25 is a view showing details of the part of the coil forming apparatus in forming a left hand coil by using one point tool.

To form a left hand coil by using the second point tool, as shown in FIG. 25, the second tool fixing block 272 to which the second point tool T2 is attached is mounted, parallel to the straight line L2 along the feed direction F of the wire W, on the second parallel moving table 262. The first vertical moving table 231 of the first tool drive unit 230 is retracted to the lower position without being driven. The first parallel moving table 232 is retracted to the rear position. In this retracted state, the first point tool T1 may or may not be attached to the first tool fixing block 242 of the first tool drive unit 230. The second vertical moving table 261 is moved downward by driving the second vertical driving motor 263 in accordance with a desired coil wind direction (in this case, left hand wind). The second parallel moving table 262 is moved to a predetermined position in the longitudinal direction in accordance with a desired coil diameter by driving the second cam driving motor 271. The distance of the mandrel 282 from the output portion O1 of the wire W is set by driving the base driving motor 289 in accordance with the desired coil diameter. Thus the mandrel 282 is set in a predetermined position below the straight line L2 along the feed direction F of the wire W on the forming table.

Note that the same reference numerals as in FIG. 22 denote the same parts in FIG. 25, and a detailed description thereof will be omitted.

<Formation of full-elliptic coil>

Figure 26A:
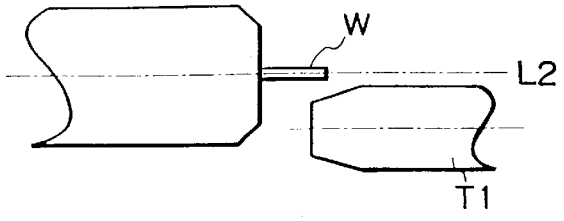
FIG. 26A is a view for explaining point tool operation for forming a full-elliptic spring with a desired coil diameter in a desired coil wind direction.
Figure 26B:
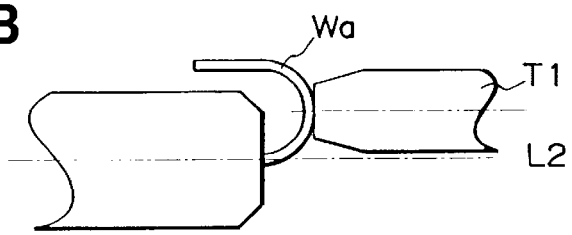
FIG. 26B is a view for explaining point tool operation for forming a full-elliptic spring with a desired coil diameter in a desired coil wind direction.
Figure 26C:
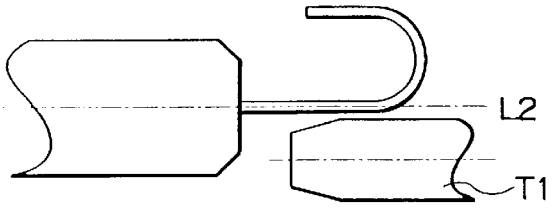
FIG. 26C is a view for explaining point tool operation for forming a full-elliptic spring with a desired coil diameter in a desired coil wind direction.
Figure 26D:
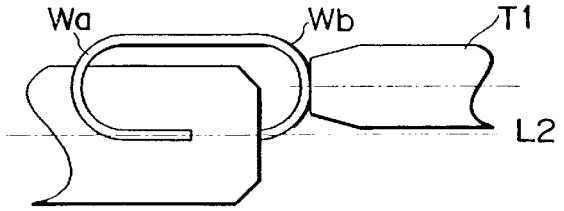
FIG. 26D is a view for explaining point tool operation for forming a full-elliptic spring with a desired coil diameter in a desired coil wind direction.
Figure 26E:
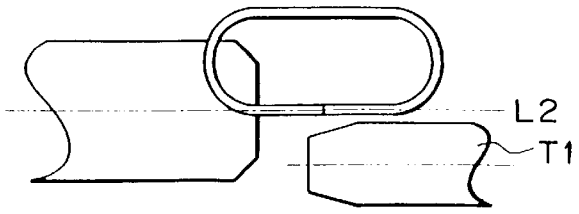
FIG. 26E is a view for explaining point tool operation for forming a full-elliptic spring with a desired coil diameter in a desired coil wind direction.

To form a right hand full-elliptic coil by using the first point tool, as shown in FIGS. 26A to 26E, the first vertical moving table 231 and the first parallel moving table 232 are moved to move the first point tool T1 to a position underneath the straight line L2 along the feed direction F of the wire W, and the wire W is fed by a length exceeding the end portion of the first point tool T1 (FIG. 26A). In this state, the first vertical moving table 231 and the first parallel moving table 232 are moved to move the first point tool T1 to a position above the straight line L2 along the feed direction F of the wire W, and the wire W is fed to form a first curved portion Wa (FIG. 26B). Next, the first vertical moving table 231 and the first parallel moving table 232 are moved to move the first point tool T1 to the position underneath the straight line L2 along the feed direction F of the wire W, and the wire W is fed by a predetermined length to form a straight portion of the full-elliptic coil (FIG. 26C). Subsequently, the first vertical moving table 231 and the first parallel moving table 232 are moved to move the first point tool T1 to the position above the straight line L2 along the feed direction F of the wire W, and the wire W is fed to form a second curved portion Wb (FIG. 26D). Finally, the first vertical moving table 231 and the first parallel moving table 232 are moved to move the first point tool T1 to the position below the straight line L2 along the feed direction F of the wire W, and the wire W is fed by a predetermined length to form a straight portion of the full-elliptic coil (FIG. 26E).

To form a left hand full-elliptic coil, it is only necessary to execute symmetric operation with respect to the feed direction L2 of the wire W by using the second point tool T2 in the operation of the first point tool T1 shown in FIGS. 26A to 26E.

The number of point tools (single pin or twin pins) used in coil formation can be changed in accordance with the coil diameter of a spring or the shape of the mandrel. For example, the use of one point tool is preferable when the coil diameter is small (when the coil outside diameter is 20 mm or less). Conversely, the use of two point tools is preferable when the coil diameter is large (when the coil outside diameter is 40 mm or more).

Especially when the wire W is initially wound in the above formation, a point tool to be used is retracted, the wire W is fed by a length by which the end portion of the wire W and the tool do not interfere with each other, and then the point tool is moved to the coil formation position. This facilitates the formation work.

[Normal operation of point tool]

FIG. 15A is a view showing the loci of point tools moved in accordance with the coil diameter when a right hand coil is formed by using the first and second point tools.

To increase the coil diameter, for example, first and second point tools T1-1 and T2-1 are moved to point tools T1-2 and T2-2, respectively. As shown in FIG. 15A, the first vertical moving table 231 and the first parallel moving table 232 are so driven that the locus of the end portion of the first point tool T1 forms a straight line k2 which intersects the straight line L2 parallel to the feed direction F of the wire W at an angle θ4 around 67.5°. The second vertical moving table 261 and the second parallel moving table 262 are so driven in accordance with a desired wire diameter that the locus of the end portion of the second point tool T2 forms a straight line k1 which intersects the straight line L2 parallel to the feed direction F of the wire W at an angle θ3 of approximately 22.5°.

FIG. 15B is a view showing the locus of a point tool moved in accordance with the coil diameter when a right hand coil is formed by using the first point tool.

To increase the coil diameter, for example, the first point tool T1-1 is moved to the point tool T1-2. As shown in FIG. 15B, the first vertical moving table 231 and the first parallel moving table 232 are so driven in accordance with a desired wire diameter that the locus of the end portion of the point tool T1 forms a straight line K3 which intersects the straight line L2 parallel to the feed direction F of the wire W at an angle θ5 of about 45°.

To form left hand coils, the point tools shown in FIGS. 15A and 15B need only be operated symmetrically with respect to the straight line L2.

[Operation of finely adjusting coil center]

FIGS. 27A to 27E are views for explaining fine adjustment of the coil center.

Figure 27A:
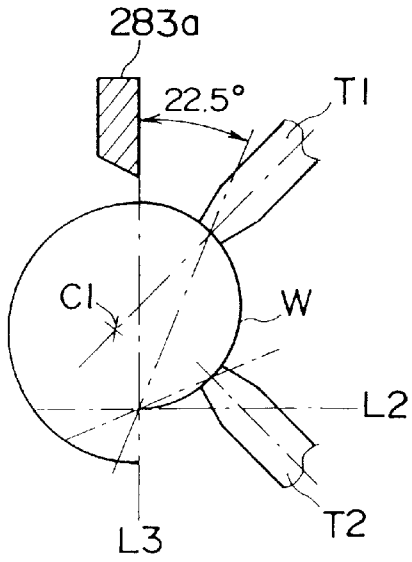
FIG. 27A is a view showing the state in which the center of the coil diameter of a right hand coil is offset when the oil is formed by two point tools.

This coil center fine adjustment is an operation of correcting a center C1 of the coil diameter shown in FIG. 27A so that the center C1 approaches appropriate cutting positions shown in FIGS. 27B to 27E.

Figure 27B:
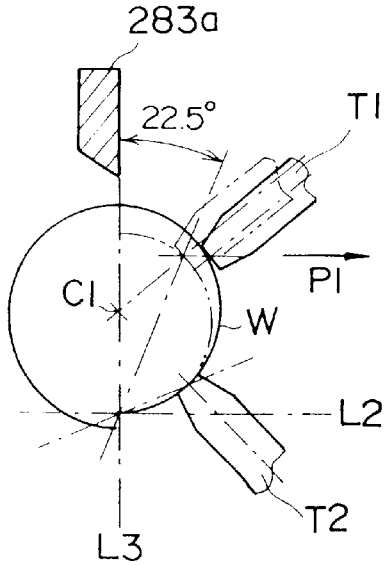
FIG. 27B is a view showing point tool operation for finely adjusting the coil diameter center from the state shown in FIG. 27A.

Referring to FIG. 27B, the first point tool T1 is moved backward in a direction P1 parallel to the straight line L2 from the state shown in FIG. 27A. Consequently, the center C1 of the coil diameter can be moved onto a locus L3 of the cutting tool 283*a*.

Figure 27C:
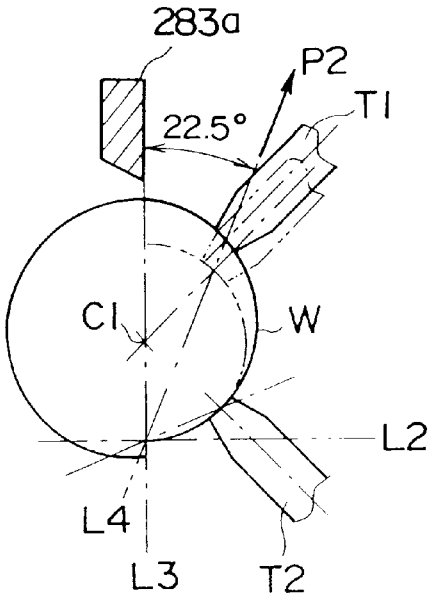
FIG. 27C is a view showing point tool operation for finely adjusting the coil diameter center from the state shown in FIG. 27A.

Referring to FIG. 27C, the first point tool T1 is moved off to the upper right in a direction P2 along a straight line L4 which intersects the straight line L2 at an angle of 67.5° from the state shown in FIG. 27A. Consequently, the center C1 of the coil diameter can be moved onto the locus L3 of the cutting tool 283*a*.

Figure 27D:
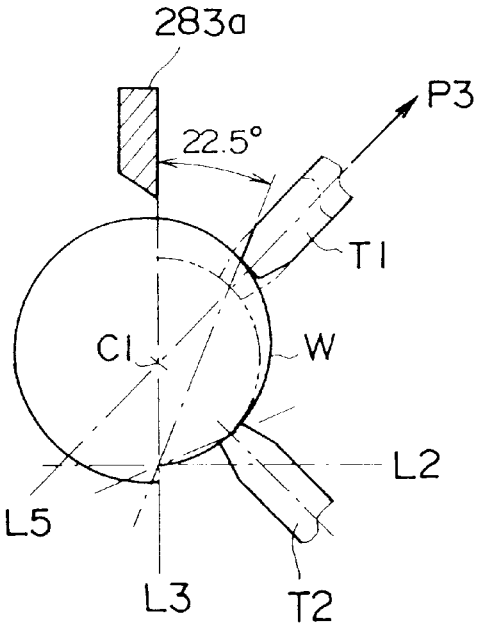
FIG. 27D is a view showing point tool operation for finely adjusting the coil diameter center from the state shown in FIG. 27A.

Referring to FIG. 27D, the first point tool T1 is moved off to the upper right in a direction P3 along a straight line L5 which intersects the straight line L2 at an angle of 45° from the state shown in FIG. 27A. Consequently, the center C1 of the coil diameter can be moved onto the locus L3 of the cutting tool 283*a*.

Figure 27E:
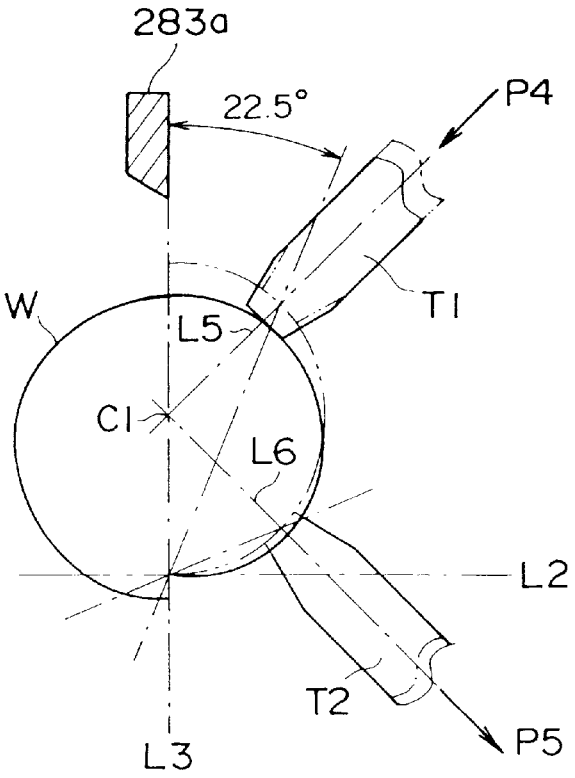
FIG. 27E is a view showing point tool operation for finely adjusting the coil diameter center from the state shown in FIG. 27A.

Referring to FIG. 27E, the first point tool T1 is moved off to the upper right in a direction P4 along a straight line L5 which intersects the straight line L2 at an angle of 45° from the state shown in FIG. 27A. At the same time, the second point tool T2 is moved off to the lower right in a direction P5 along a straight line L6 which intersects the straight line L2 at an angle of 45° from the state shown in FIG. 27A. Consequently, the center C1 of the coil diameter can be moved onto the locus L3 of the cutting tool 283*a*.

Figure 27F:
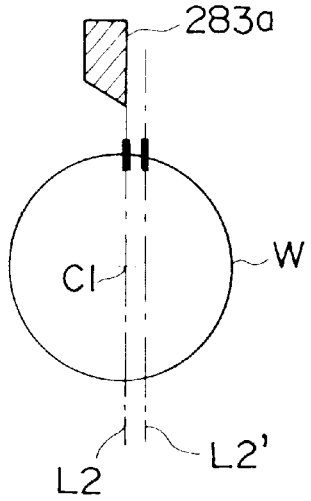
FIG. 27F is a view for explaining deviation correction of the cutting position when the coil diameter center is finely adjusted from the state shown in FIG. 27A.

In the fine adjustment of the coil diameter center described above, as shown in FIG. 27F, if the position of a coil to be cut by the cutting tool 283*a* deviates from the center C1 as indicated by a locus L2' (this positional deviation sometimes brings about inconvenience when the coil is assembled as a part into an apparatus), the deviation can be corrected so that the cutting tool moves on the locus L2 passing through the center C1 by slightly moving the first point tool T1 or the second point tool T2.

[Operation of initially winding coil]

Operation of initially winding a coil will be described below with reference to FIGS. 29A to 29C.

Conventionally, the end portion of the wire W and the point tools interfere with each other when a coil is initially wound. Therefore, the work is manually performed by feeding the wire W until the state shown in FIG. 29C is obtained.

In this embodiment, this complicated work can be omitted by numerically controlling the operations of the tools.

Figure 29A:
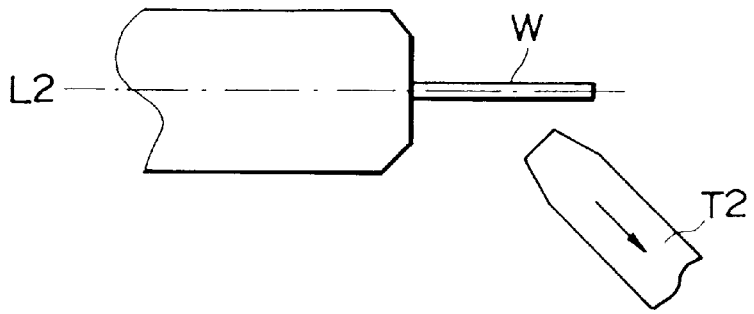
FIG. 29A is a view for explaining operation of initially winding a coil.
Figure 29B:
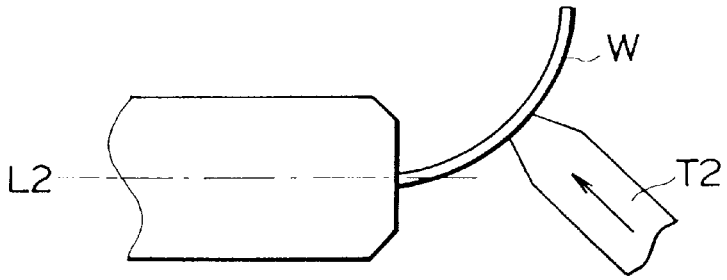
FIG. 29B is a view for explaining operation of initially winding a coil.
Figure 29C:
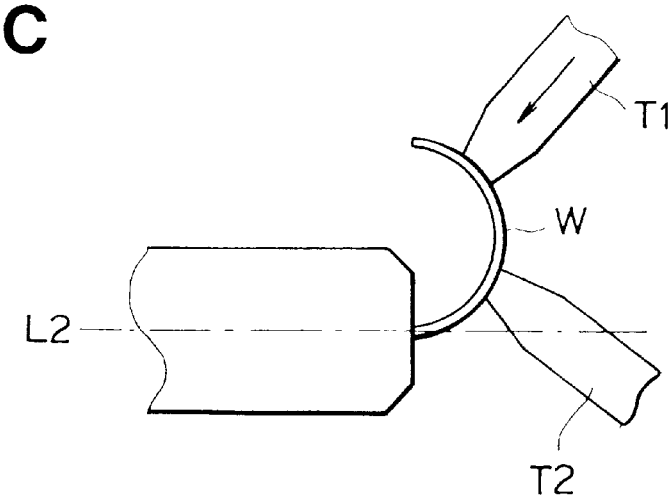
FIG. 29C is a view for explaining operation of initially winding a coil.

That is, to form a right hand coil by using the first and second point tools T1 and T2, as shown in FIGS. 29A to 29C, the second vertical moving table 261 and the second parallel moving table 262 are moved to retract the second point tool T2 to a position beneath the straight line L2 along the feed direction F of the wire W, and the wire W is fed by a length exceeding the end portion of the second point tool T2 (FIG. 29A). In this state, the second vertical moving table 261 and the second parallel moving table 262 are moved to move the second point tool T2 to a position above the straight line L2 along the feed direction F of the wire W, and the wire W is fed while the second point tool T2 is in contact with the wire W (FIG. 29B). Next, the first vertical moving table 231 and the first parallel moving table 232 are moved to press the first point tool T1 against the wire W, and the wire W is fed by a predetermined length (FIG. 29C).

Since the first and second point tools T1 and T2 are controlled as above, the coil formation work can be automatically done without any interference between the wire W and the tools even when a coil is initially wound.

Note that in the procedures of changing the coil wind direction and the coil diameter described above, a control block shown in FIG. 30 (to be described later) controls the first and second vertical driving motors 233 and 236 for moving the first and second vertical moving tables 231 and 261 and the first and second cam driving motors 241 and 271 for moving the first and second parallel moving tables 232 and 262.

In this embodiment described above, when the wind direction, the coil diameter, or the like of a coil is to be changed, the relative positional relationship can be easily adjusted without removing the point tools and their driving mechanisms from the forming table.

Also, in setting or changing the wind direction, the coil diameter, or the like of a coil, a new coil diameter or the like can be readily set only by vertically and horizontally moving the relative positional relationship between the first and second point tools.

Additionally, the first and second point tools are arranged on the first and second tool drive units which are numerically controlled independently of each other, and each point tool is moved vertically and horizontally. Therefore, it is possible to finely adjust the positional relationship between the two point tools by numerical control and completely automate the spring formation.

Furthermore, the operations of the first and second point tools can be numerically controlled independently of each other. Accordingly, when a spring with varying coil diameter is to be formed, it is possible to properly control the loci of the two point tools, finely adjust the coil cutting position to an appropriate position, and facilitate the work of initially winding the wire.

Moreover, each of the first and second tool drive units need only have a mechanism which vertically and horizontally moves one point tool. Consequently, it is possible to reduce the table weight, use a low-output motor for table driving, and attain rapid operation.

[Control circuit configuration]

The control circuit configuration of the spring manufacturing apparatus 200 will be described below.

Figure 30:
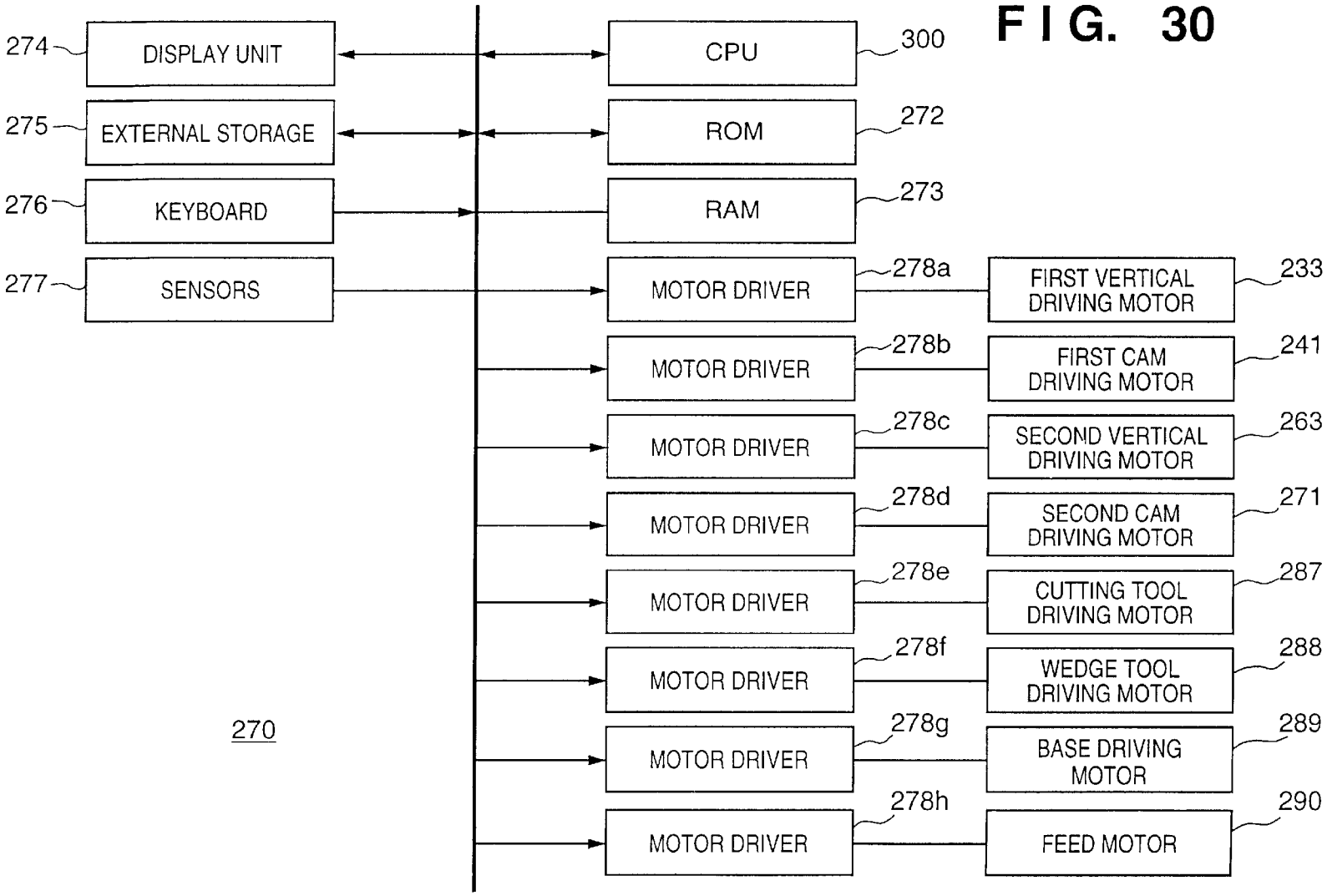
FIG. 30 is a block diagram showing the electrical configuration of a coil forming apparatus and a controller of the spring manufacturing apparatus.
Figure 31:
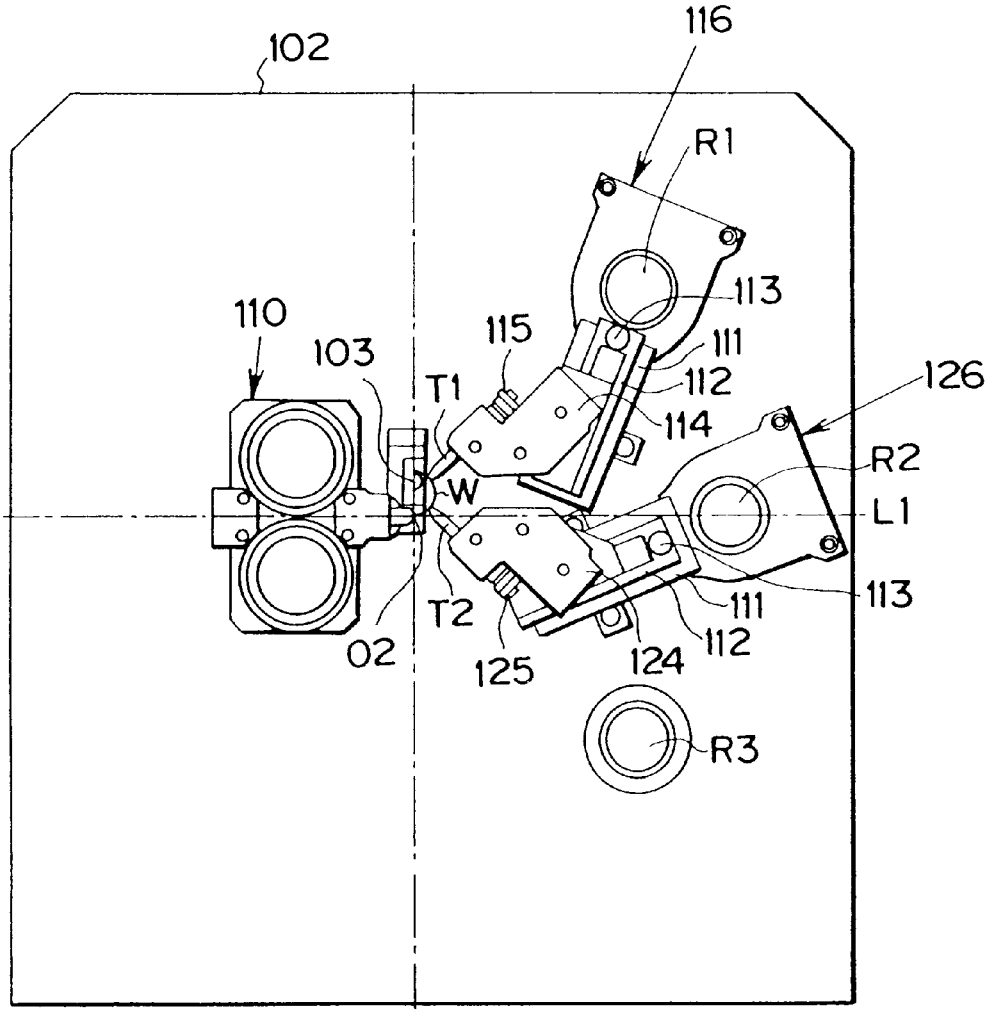
FIG. 31 (PRIOR ART)
FIG. 31 is a front view showing point tools arranged on a forming table when a right hand coil is formed by using two point tools in a conventional spring manufacturing apparatus.
Figure 32:
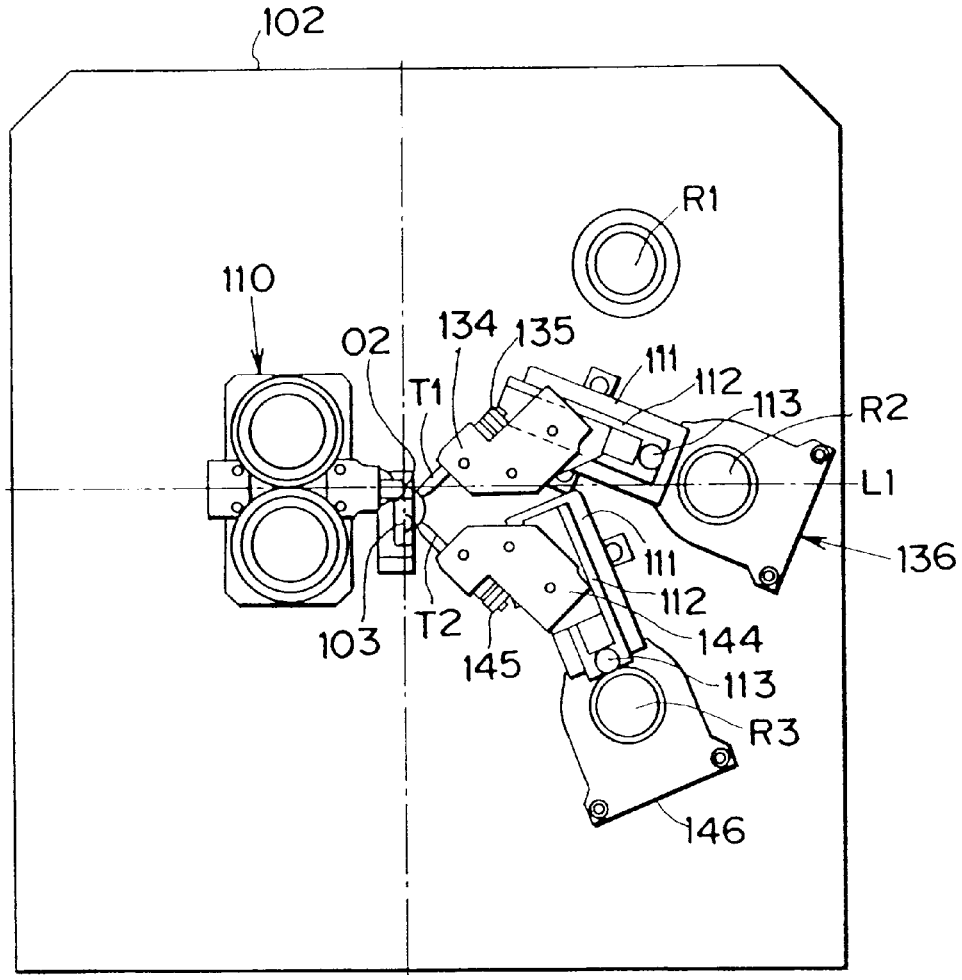
FIG. 32 (PRIOR ART)
FIG. 32 is a front view showing point tools arranged on a forming table when a left hand coil is formed by using two point tools in the conventional spring manufacturing apparatus.
Figure 33:
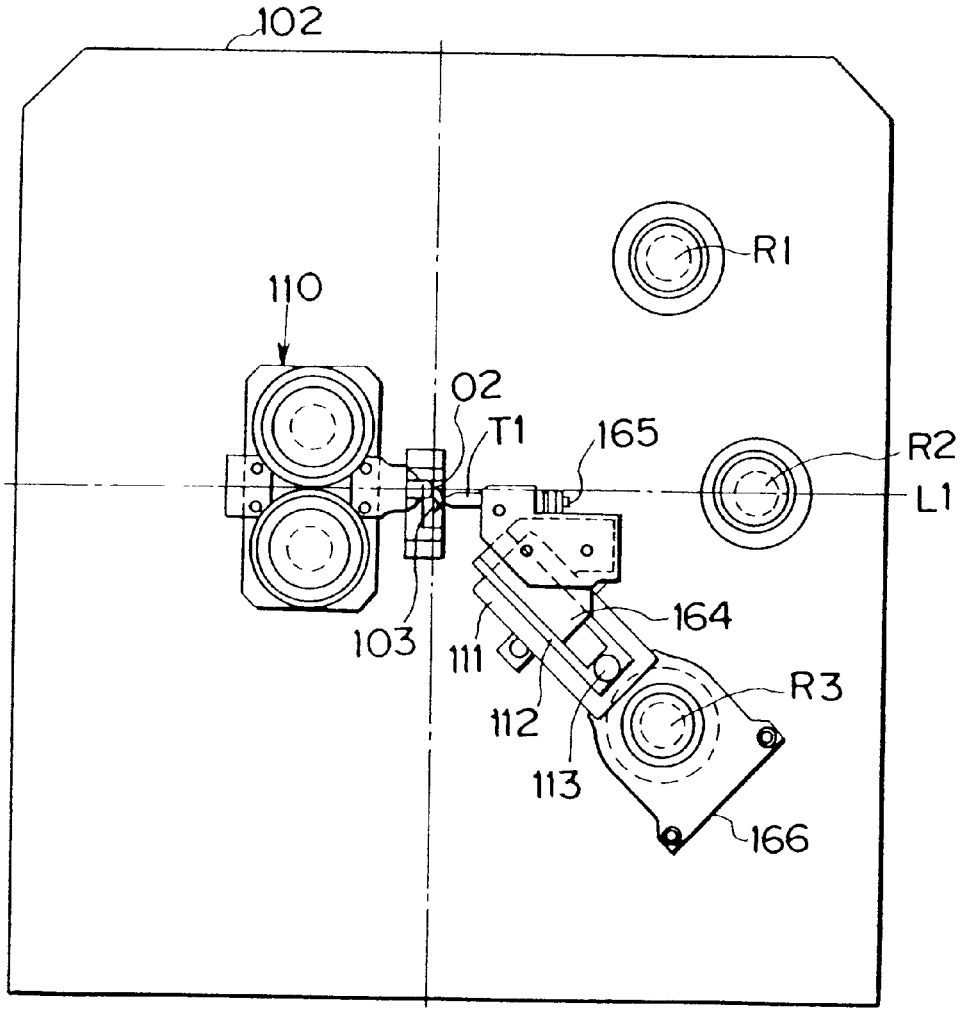
FIG. 33 (PRIOR ART)
FIG. 33 is a front view showing a point tool arranged on a forming table when a right hand coil is formed by using one point tool in the conventional spring manufacturing apparatus.
Figure 34:
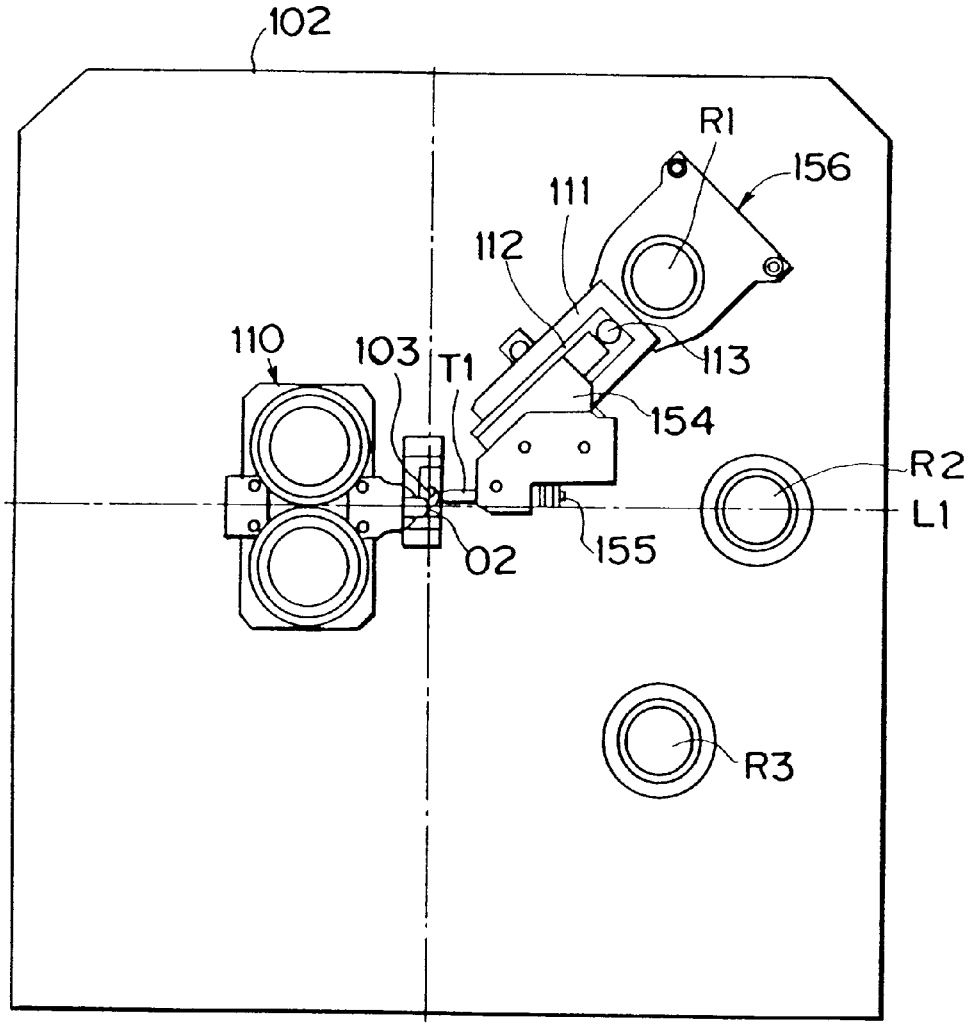
FIG. 34 (PRIOR ART)
FIG. 34 is a front view showing a point tool arranged on a forming table when a left hand coil is formed by using one point tool in the conventional spring manufacturing apparatus.

FIG. 30 is a block diagram showing the relationship between the coil forming apparatus 220 and the controller 270.

As shown in FIG. 30, a CPU 300 controls the whole controller 270. A ROM 272 stores the contents (programs) of processing of the CPU 300 and the like. A RAM 273 is used as the work area of the CPU 300 and stores, e.g., control programs and position data downloaded from the ROM 272. A display unit 274 is, e.g., a liquid crystal display and used to perform various settings, display the setting contents, and display the process of manufacture and the like in the form of graphs. An external storage 275 is a floppy disk drive, a CD-ROM drive, or the like and used to externally supply programs or store the contents of various settings for wire formation processing. Consequently, when parameters for certain processing (e.g., the free length and the diameter in the case of a spring) are stored in a floppy disk, springs having the same shape can be manufactured at any time by setting and executing this floppy disk.

A keyboard 276 is used to set various parameters. Sensors 277 are used to sense the feed amount of a wire and the free length and the like of a spring.

The first and second vertical driving motors 233 and 263, the first and second cam driving motors 241 and 271, the cutting tool driving motor 287, the wedge tool driving motor 288, the base driving motor 289, and the feed motor 290 are driven by corresponding motor drivers 278*a* to 278*h*.

In this control block, in accordance with input instructions from the keyboard 276, the CPU 300 numerically controls the first and second vertical driving motors 233 and 263, the first and second cam driving motors 241 and 271, the cutting tool driving motor 287, the wedge tool driving motor 288, the base driving motor 289, and the feed motor 290 independently of each other, controls input/output operations with respect to the external storage 275, and also controls the display unit 274.

When the control block described above is used, the positional relationship between the first point tool T1, the second point tool T2, the cutting tool 283*a*, the wedge tool 284*a*, and the cutting and wedge tool drive unit 280 and the timing and amount by which the wire is fed by the feed rollers 211 and 212 can be numerically, automatically controlled only by setting or changing the parameters such as the wind direction, the coil diameter, and the like of a coil.

Furthermore, the operations of the first and second point tools can be numerically controlled independently of each other. Accordingly, when a spring with varying coil diameter is to be formed, it is possible to properly control the loci of the two point tools, finely adjust the coil cutting position to an appropriate position, and facilitate the work of initially winding the wire.

The present invention is applicable to an alteration or a modification of the above embodiment without departing from the gist of the invention.

[Effects]

In the second embodiment as described above, when the wind direction, the coil diameter, or the like of a coil is to be changed, the relative positional relationship can be readily adjusted without removing point tools and their driving mechanisms from a forming table, while the tip shape of a tool or the like is changed where necessary.

Also, in setting or changing the wind direction, the coil diameter, or the like of a coil, a new coil diameter or the like can be readily set only by vertically and horizontally moving the relative positional relationship between point tools.

Additionally, two point tools are arranged on tables which operate independently of each other, and these tables are moved vertically and horizontally. Therefore, it is possible to finely adjust the positional relationship between the two point tools by numerical control and completely automate the spring formation.

Furthermore, the operations of the two point tools can be numerically controlled independently of each other. Accordingly, when a spring with varying coil diameter is to be formed, it is possible to properly control the loci of the two point tools, finely adjust the coil cutting position to an appropriate position, and facilitate the work of initially winding the wire.

Moreover, each table need only have a mechanism which vertically and horizontally moves one point tool. Consequently, it is possible to reduce the table weight, use a low-output motor for table driving, and realize rapid operation.

As many apparently widely different embodiments of the present invention can be made without departing from the spirit and scope thereof, it is to be understood that the invention is not limited to the specific embodiments thereof except as defined in the appended claims.

What is claimed is:

1. A spring manufacturing apparatus for forming a coil spring having a desired shape by feeding a wire to be formed into a spring onto a forming table and pressing tools disposed on said forming table against the feed wire, characterized by comprising, on said forming table:

wire feeding means for feeding the wire onto said forming table;

tool support means for supporting said tools in positions where said tools oppose the fed wire; and moving means for moving said tool support means in a direction substantially parallel to a forming table surface and substantially perpendicular to a wire feed direction and in a direction substantially parallel to the forming table surface and the wire feed direction, wherein said moving means including a first table movable in the direction parallel to the forming table surface and perpendicular to the wire feed direction, a second table movable in the direction parallel to the forming table surface and the wire feed direction independently of said first table, a third table disposed on said first table and slidable in the direction parallel to the forming surface and the wire feed direction, and a fourth table disposed on said first table and movable in a direction parallel to the forming table surface and inclined to the wire feed direction; and linking means, disposed on said first table, for moving said third and fourth table upon movement of said second table, moves said tool support means to make tool end portions draw predetermined loci with respect to the feed direction of the wire.

2. The apparatus according to claim 1, characterized in that said fourth table comprises a fifth table and a sixth table disposed to be movable in a direction inclined through an angle of substantially 45° to the wire feed direction and slidable with respect to said third table so as to converge into a center of a desired coil diameter.

3. The apparatus according to claim 1, characterized by further comprising:

a roller mechanism disposed on said second table to allow said linking means to move in the direction parallel to the forming table surface and perpendicular to the wire feed direction with respect to said second table, wherein said linking means abuts against said second table via said roller mechanism to transmit motion of said second table to said third and fourth tables.

4. The apparatus according to claim 1, characterized by further comprising:

first driving means for driving said first table;

second driving means for driving said second table;

third driving means for driving said wire feeding means; and control means for controlling said first to third driving means in accordance with a desired coil shape.

5. The apparatus according to claim 1, characterized in that said third table is moved in accordance with a desired wire diameter to make a locus of an end portion of a tool disposed on said third table form a straight line which intersects a straight line parallel to the wire feed direction at an angle of substantially 45°.

6. The apparatus according to claim 1, characterized in that said linking means moves said third and fourth tables the same distance upon movement of said second table.

7. The apparatus according to claim 2, characterized in that said tool support means is disposed on said third table or said fifth and sixth tables.

8. The apparatus according to claim 2, characterized in that said linking means has a shape symmetrical with respect to said third table, comprises inclined portions inclined through 22.5° in the direction perpendicular to the wire feed direction in two end portions, and moves said fifth and sixth tables in accordance with a desired wire diameter to make a locus of an end portion of a tool disposed on said fifth table form a straight line which intersects a straight line parallel to the wire feed direction at an angle of substantially 67.5°, and a locus of an end portion of a tool disposed on said sixth table form a straight line which intersects the straight line parallel to the wire feed direction at an angle of 22.5°.

9. The apparatus according to claim 2, characterized in that said linking means moves an isosceles triangle formed by connecting central lines along moving directions of said linking means and fifth and sixth tables in the direction parallel to the forming table surface and the wire feed direction or in the direction parallel to the forming table surface and perpendicular to the wire feed direction.

10. A spring manufacturing apparatus for forming a coil spring having a desired shape by feeding a wire to be formed into a spring onto a forming table and pressing tools disposed on said forming table against the feed wire, characterized by comprising, on said forming table:

wire feeding means for feeding the wire onto said forming table;

two independent moving means for supporting said tools in positions where said tools oppose the wire and moving said tools in a direction substantially parallel to a forming table surface and substantially perpendicular to a wire feed direction and in a direction substantially parallel to the forming table surface and the wire feed direction; and control means for controlling said moving means independently of each other to make tools end portions draw predetermined loci with respect to the wire feed direction, wherein said moving means comprises first moving means disposed upstream with respect to the wire feed direction on said forming table and second moving means disposed downstream with respect to the wire feed direction on said forming table, and each of said first and second moving means comprises:

a vertical moving table movable in the direction parallel to the forming table surface and perpendicular to the wire feed direction; and a parallel moving table movable in the direction parallel to the forming table surface and the wire feed direction.

11. The apparatus according to claim 10, characterized in that said first and second moving means comprise first and second tool support means, respectively, for slidably supporting said tools at an angle of substantially 45° with respect to the wire feed direction to make said tools converge into a center of a desired coil diameter, and said first and second tool support means are disposed on said parallel moving tables of said first and second moving means.

12. The apparatus according to claim 10, characterized by further comprising:

first driving means for moving said vertical moving table of said first moving means;

second driving means for moving said parallel moving table of said first moving means;

third driving means for moving said vertical moving table of said second moving means; and fourth driving means for moving said parallel moving table of said second moving means.

13. The apparatus according to claim 11, characterized by further comprising:

first driving means for moving said vertical moving table of said first moving means;

second driving means for moving said parallel moving table of said first moving means;

third driving means for moving said vertical moving table of said second moving means; and fourth driving means for moving said parallel moving table of said second moving means.

14. The apparatus according to claim 13, characterized in that each of said parallel moving tables of said first and second moving means comprises a roller mechanism for allowing said parallel moving table to move in the direction parallel to the forming table surface and perpendicular to the wire feed direction with respect to said vertical moving table, and each of said second and fourth driving means moves said parallel moving table via said roller mechanism.

15. The apparatus according to claim 13, characterized in that said first to fourth driving means are numerically controlled independently of each other by said control means.

16. The apparatus according to claim 15, characterized in that said control means controls said first to fourth driving means in accordance with a desired coil diameter to make a locus of an end portion of a tool disposed on said first moving means form a straight line which intersects a straight line parallel to the wire feed direction at an angle of substantially 67.5°, and a locus of an end portion of a tool disposed on said second moving means form a straight line which intersects the straight line parallel to the wire feed direction at an angle of 22.5°.

17. The apparatus according to claim 15, characterized in that said control means controls said first to fourth driving means in accordance with a desired coil diameter to make a locus of an end portion of a tool disposed on said first moving means form a straight line which intersects a straight line parallel to the wire feed direction at an angle of substantially 22.5°, and a locus of an end portion of a tool disposed on said second moving means form a straight line which intersects the straight line parallel to the wire feed direction at an angle of 67.5°.

18. The apparatus according to claim 15, characterized in that said control means controls said first to fourth driving means in accordance with a desired coil diameter to make a locus of an end portion of a tool disposed on one of said first and second moving means form a straight line which intersects a straight line parallel to the wire feed direction at an angle of substantially 45°.

19. The apparatus according to claim 15, characterized in that said control means controls said first to fourth driving means so as to move the coil diameter center onto a locus of a cutting tool for cutting the wire.

20. The apparatus according to claim 15, characterized in that said control means controls said first to fourth driving means to prevent an end portion of the wire and said tools disposed on said first and second moving from interfering with each other when the wire is initially wound into a desired coil diameter.

21. The apparatus according to claim 12, characterized in that each of said parallel moving tables of said first and second moving means comprises a roller mechanism for allowing said parallel moving table to move in the direction parallel to the forming table surface and perpendicular to the wire feed direction with respect to said vertical moving table, and each of said second and fourth driving means moves said parallel moving table via said roller mechanism.

22. The apparatus according to claim 12, characterized in that said first to fourth driving means are numerically controlled independently of each other by said control means.

23. The apparatus according to claim 22, characterized in that said control means controls said first to fourth driving means in accordance with a desired coil diameter to make a locus of an end portion of a tool disposed on said first moving means form a straight line which intersects a straight line parallel to the wire feed direction at an angle of substantially 67.5°, and a locus of an end portion of a tool disposed on said second moving means form a straight line which intersects the straight line parallel to the wire feed direction at an angle of 22.5°.

24. The apparatus according to claim 22, characterized in that said control means controls said first to fourth driving means in accordance with a desired coil diameter to make a locus of an end portion of a tool disposed on said first moving means form a straight line which intersects a straight line parallel to the wire feed direction at an angle of substantially 22.5°, and a locus of an end portion of a tool disposed on said second moving means form a straight line which intersects the straight line parallel to the wire feed direction at an angle of 67.5°.

25. The apparatus according to claim 22, characterized in that said control means controls said first to fourth driving means in accordance with a desired coil diameter to make a locus of an end portion of a tool disposed on one of said first and second moving means form a straight line which intersects a straight line parallel to the wire feed direction at an angle of substantially 45°.

26. The apparatus according to claim 22, characterized in that said control means controls said first to fourth driving means so as to move the coil diameter center onto a locus of a cutting tool for cutting the wire.

27. The apparatus according to claim 22, characterized in that said control means controls said first to fourth driving means to prevent an end portion of the wire and said tools disposed on said first and second moving from interfering with each other when the wire is initially wound into a desired coil diameter.

* * * * *